US010557184B2

(12) United States Patent
Goto et al.

(10) Patent No.: US 10,557,184 B2
(45) Date of Patent: Feb. 11, 2020

(54) METHOD FOR MANUFACTURING COPPER ALLOY AND COPPER ALLOY

(71) Applicants: NGK INSULATORS, LTD., Nagoya (JP); TOHOKU UNIVERSITY, Senda-Shi (JP)

(72) Inventors: Takashi Goto, Sendai (JP); Hirokazu Katsui, Sendai (JP); Naokuni Muramatsu, Nagoya (JP); Masaaki Akaiwa, Handa (JP)

(73) Assignees: NGK Insulators, Ltd., Nagoya (JP); Tohoku University, Sendai (JP)

( * ) Notice: Subject to any disclaimer, the term of this patent is extended or adjusted under 35 U.S.C. 154(b) by 465 days.

(21) Appl. No.: 15/356,960

(22) Filed: Nov. 21, 2016

(65) Prior Publication Data

US 2017/0130299 A1 May 11, 2017

Related U.S. Application Data

(63) Continuation of application No. PCT/JP2016/057847, filed on Mar. 11, 2016.
(Continued)

(30) Foreign Application Priority Data

Oct. 16, 2015 (JP) ..... 2015-204590

(51) Int. Cl.
*C22C 9/00* (2006.01)
*B22F 3/105* (2006.01)
*C22C 1/04* (2006.01)

(52) U.S. Cl.
CPC ..... *C22C 9/00* (2013.01); *B22F 3/105* (2013.01); *C22C 1/0425* (2013.01); *B22F 2003/1051* (2013.01); *B22F 2998/10* (2013.01)

(58) Field of Classification Search
CPC ..... C22C 9/00; C22C 1/0425; B22F 3/105; B22F 2998/10; B22F 2003/1051
See application file for complete search history.

(56) References Cited

U.S. PATENT DOCUMENTS

2015/0225818 A1* 8/2015 Goto ..... C22C 9/00 419/28
2015/0255195 A1* 9/2015 Muramatsu ..... H01C 17/00 338/20

FOREIGN PATENT DOCUMENTS

CN 104164587 A 11/2014
JP 03-166329 A1 7/1991
(Continued)

OTHER PUBLICATIONS

English translation of International Search Report (Application No. PCT/JP2016/057847) dated Jun. 14, 2016, 2 pages.
(Continued)

*Primary Examiner* — Keith Walker
*Assistant Examiner* — John A Hevey
(74) *Attorney, Agent, or Firm* — Burr & Brown, PLLC

(57) ABSTRACT

A method for manufacturing a copper alloy according to the present invention comprises (a) weighing a copper powder and one of a Cu—Zr master alloy and a $ZrH_2$ powder such that an alloy composition of Cu-xZr (x is the atomic % of Zr, and $0.5 \leq x \leq 8.6$ is satisfied) is obtained and pulverizing and mixing the copper powder and the one of the Cu—Zr master alloy and the $ZrH_2$ powder in an inert atmosphere until an average particle diameter D50 falls within the range of from 1 μm to 500 μm to thereby obtain a powder mixture; and (b) subjecting the powder mixture to spark plasma sintering by holding the powder mixture at a prescribed temperature lower than eutectic temperature while the powder mixture is pressurized at a pressure within a prescribed range.

13 Claims, 29 Drawing Sheets

Field of View of SEM-EDX Analysis

Related U.S. Application Data

(60) Provisional application No. 62/165,366, filed on May 22, 2015.

(56) References Cited

FOREIGN PATENT DOCUMENTS

| | | | | |
|---|---|---|---|---|
| WO | 2014/069318 | A1 | 5/2014 | |
| WO | 2014/083977 | A1 | 6/2014 | |
| WO | WO-2014083977 | A1 * | 6/2014 | ..... H01C 17/00 |

OTHER PUBLICATIONS

European Search Report, European Application No. 16794497.4, dated Jan. 5, 2018 (10 pages).

Muramatsu, N., et al. "Microstructures and Mechanical and Electrical Properties of Hypoeutectic Cu-1, C-3 and Cu-5 at % Zr Alloy Wires, Preprocessed by Spark Plasma Sintering," *Materials Transactions*, vol. 54, No. 7, dated Jan. 1, 2013, pp. 1213-1219 (7 pages).

English translation of International Preliminary Report on Patentability (Application No. PCT/JP2016/057847) dated Dec. 7, 2017.

Naokuni Muramatsu, et al., "*Development of High Strength High Conductivity Hypo-Eutectic Cu—Zr Alloy SPS Material whose Starting Raw Materials are Various Powders*," Spring Meeting of Japan Society of Powder and Powder Metallurgy, May 26, 2015, p. 118.

International Search Report and Written Opinion (Application No. PCT/JP2016/057847) dated Jun. 14, 2016 (with English translation of Written Opinion as authored by Applicant's Japanese representative).

Chinese Office Action (with English translation), Chinese Application No. 201680001471.1, dated Apr. 3, 2019 (14 pages).

* cited by examiner

Field of View of SEM-EDX Analysis

FIG. 14

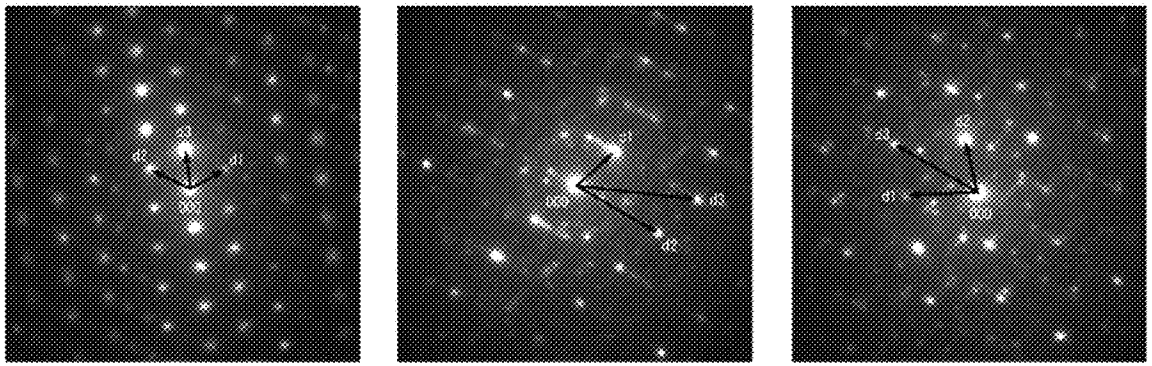

| Point 1 | Measurement Value | α-Zr | | | β-Zr | | | $CuZr_2$ | | |
|---|---|---|---|---|---|---|---|---|---|---|
| Spot | Surface Space / Å | Surface Space / Å | Surface Index hkl | Zone Axis Direction | Surface Space / Å | Surface Index hkl | Zone Axis Direction | Surface Space / Å | Surface Index hkl | Zone Axis Direction |
| d1 | 2.793 | 2.798 | 100 | - | - | - | - | 2.437 | 103 | 3 3 -1 |
| d2 | 2.529 | 2.573 | 002 | | 2.507 | 110 | | 2.277 | -110 | |
| d3 | 2.793 | 2.798 | 100 | | - | - | | 2.437 | 013 | |

[ -: No corresponding surface space, surface index, or zone axis direction]

| Point 4 | Measurement Value | $Cu_5Zr$ | | |
|---|---|---|---|---|
| Spot | Surface Space / Å | Surface Space / Å | Surface Index hkl | Zone Axis Direction |
| d1 | 2.074 | 2.071 | 311 | -1 0 3 |
| d2 | 1.146 | 1.145 | 060 | |
| d3 | 0.891 | 0.894 | 371 | |

| Point 4 Another Decination | Measurement Value | $Cu_5Zr$ | | |
|---|---|---|---|---|
| Spot | Surface Space / Å | Surface Space / Å | Surface Index hkl | Zone Axis Direction |
| d1 | 1.580 | 1.576 | 33-1 | 1 -1 0 |
| d2 | 2.063 | 2.071 | 113 | |
| d3 | 1.146 | 1.145 | 442 | |

| Compound | Pearson Symbol | Space Group | a[Å] | b[Å] | c[Å] | α[°] | β[°] | γ[°] |
|---|---|---|---|---|---|---|---|---|
| α-Zr | hP2 | $P6_3/mmc$ (194) | 3.232 | - | 5.147 | 90 | - | 120 |
| β-Zr | cI2 | Im-3m (229) | 3.545 | - | - | 90 | - | 90 |
| CuZr2 | tI6 | I4/mmm (139) | 3.220 | - | 11.183 | 90 | - | 90 |
| Cu5Zr | cF24 | F-43m (216) | 6.870 | - | - | 90 | - | 90 |

FIG. 15A
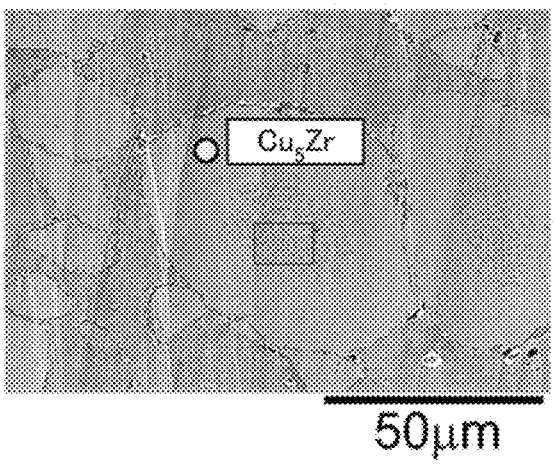
FIG. 15B
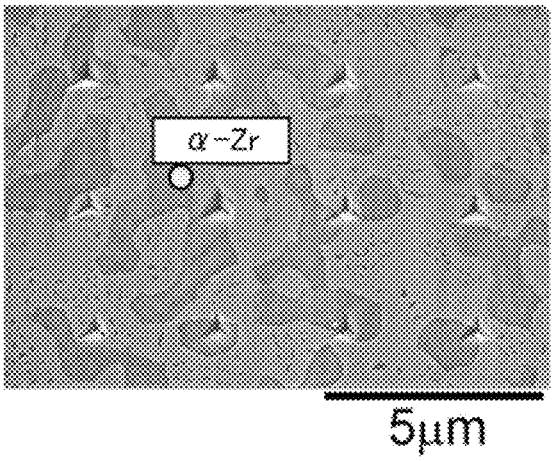
FIG. 15C
Results of measurements of Zr-rich phase by a nano-indentation method
| Zr particle | Hardness $H_{IT}$ /GPa | Young's modulus $E$ /GPa |
|---|---|---|
| Average | 3.37 (MHv311) | 75.4 |

FIG. 16
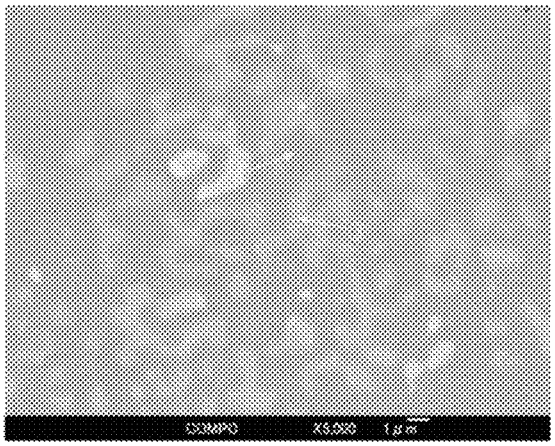
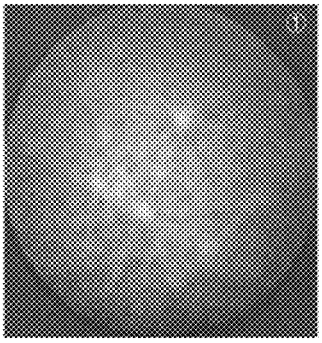
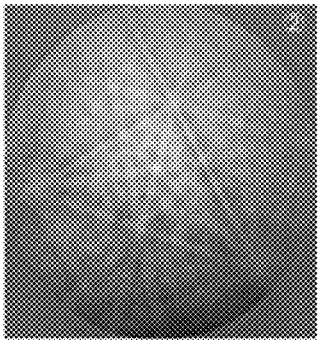
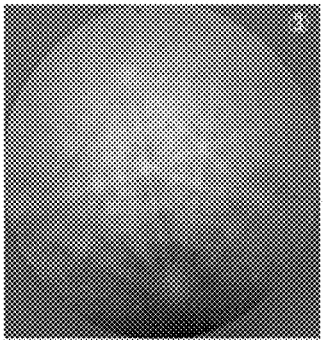
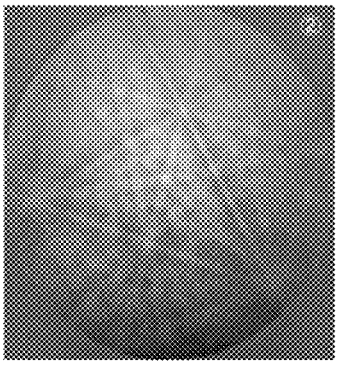
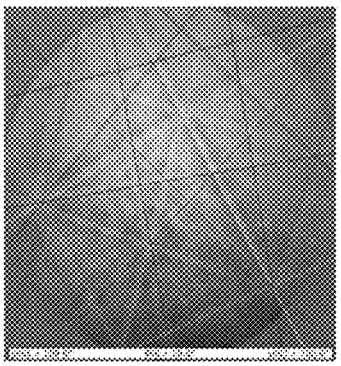
FCC
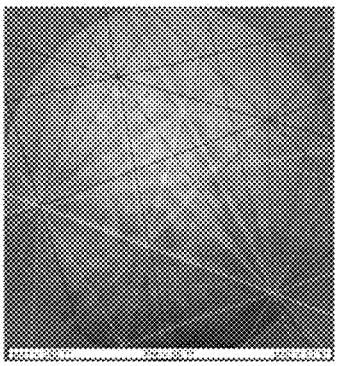
Hexagonal
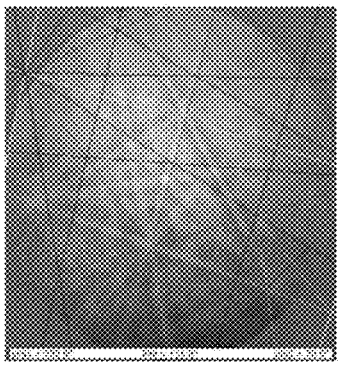
BCC

| $Cu_5Zr$ | Hardness $H_{IT}$ /GPa | Young's modulus $E$ /GPa |
|---|---|---|
| Average | 6.3 (MHv585) | 159.5 |

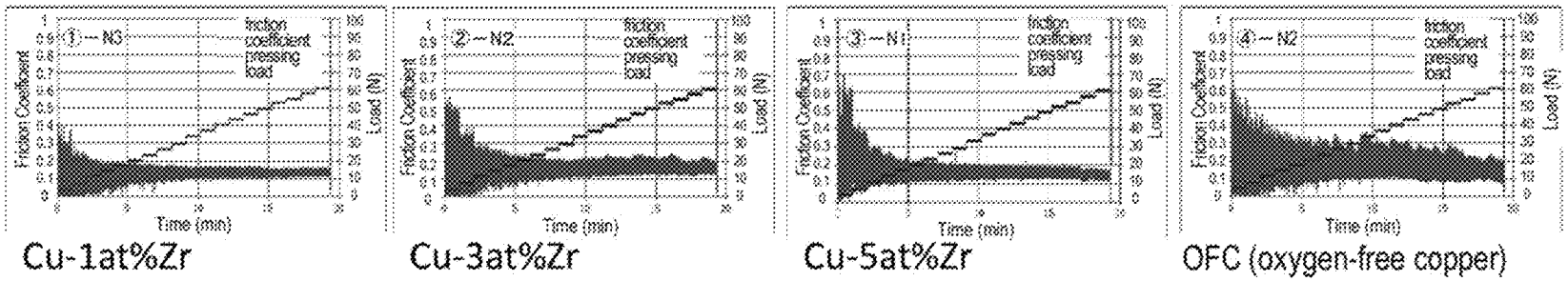
FIG. 27A Friction Coefficient
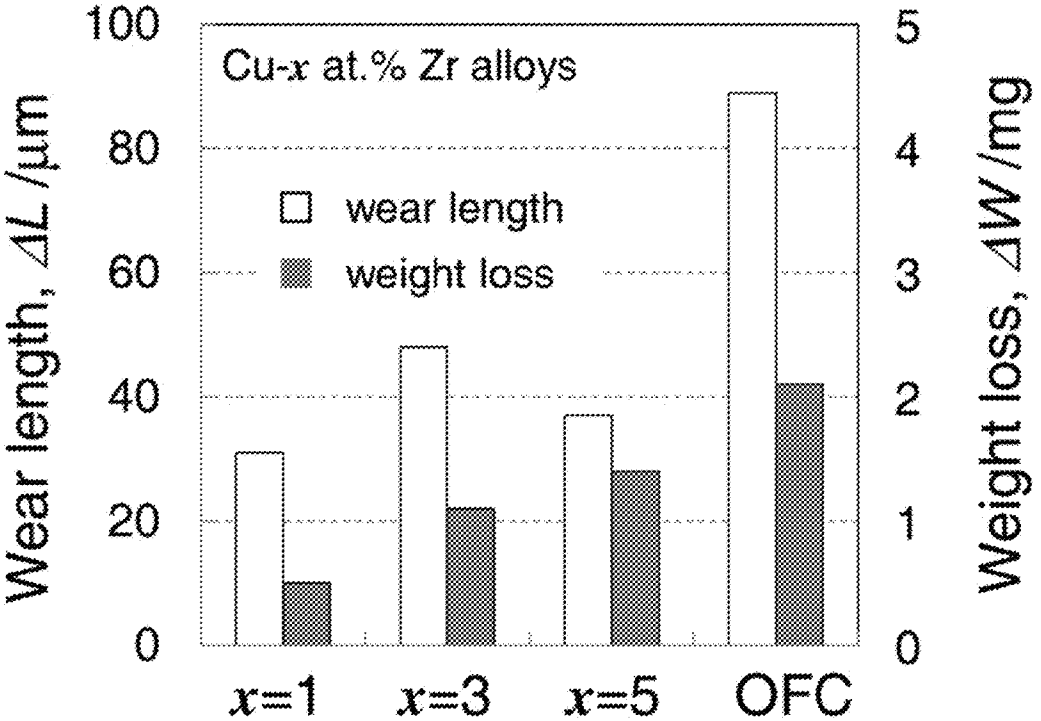
FIG. 27B Wear Length and Weight Loss

FIG. 28A
Friction Coefficient of Experimental Example 3
Cu-1at%Zr
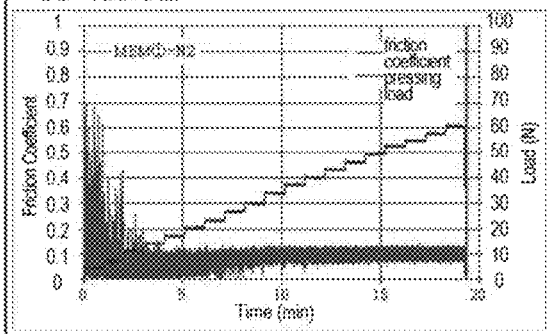
Cu-3at%Zr
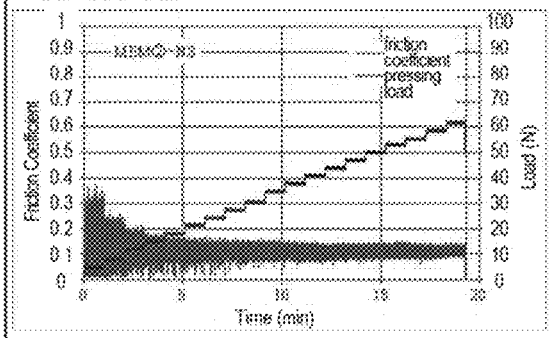
Cu-5at%Zr
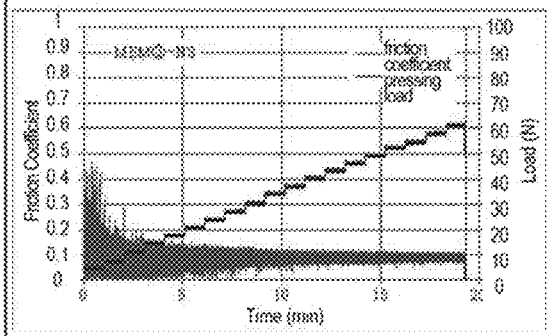
FIG. 28B
Friction Coefficient of Experimental Example 4
Cu-1at%Zr
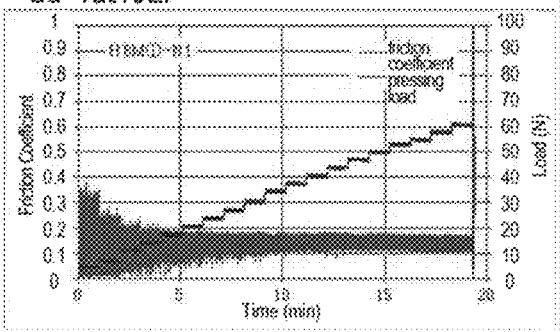
Cu-3at%Zr
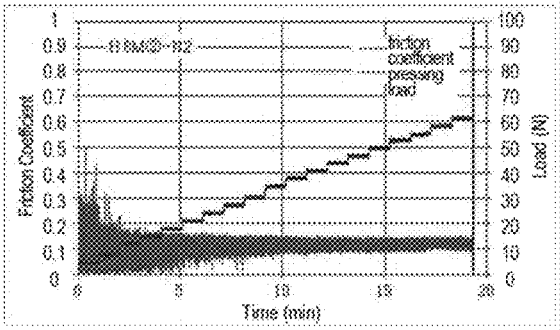
Cu-5at%Zr
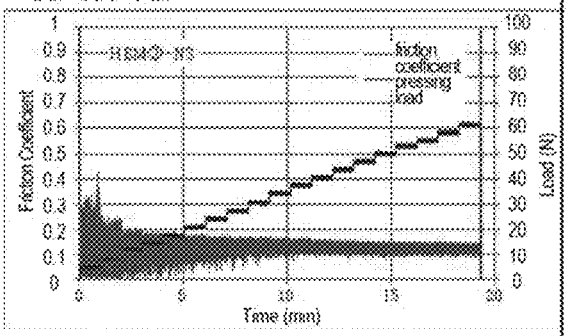
FIG. 28C
Friction Coefficient of Oxygen-free Copper
OFC
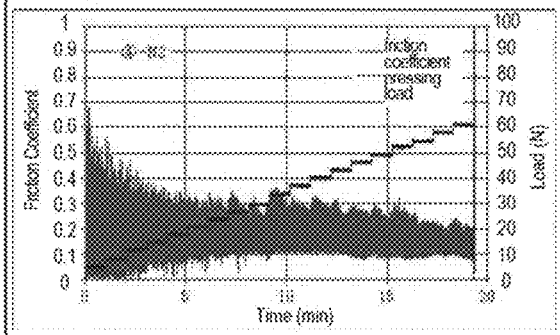
OFC
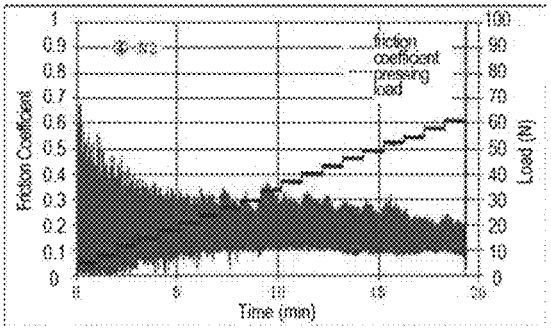

METHOD FOR MANUFACTURING COPPER ALLOY AND COPPER ALLOY

BACKGROUND OF THE INVENTION

1. Field of the Invention

The present invention relates to a method for manufacturing a copper alloy and to a copper alloy.

2. Description of the Related Art

One previously proposed copper alloy manufacturing method includes a sintering step of subjecting a binary Cu—Zr alloy powder having an average particle diameter of 30 μm or less and having a hypoeutectic composition containing Zr in an amount of from 5.00 at % to 8.00 at % to spark plasma sintering at a temperature of 0.9 Tm° C. or lower (Tm° C. is the melting point of the alloy powder) by supplying DC pulse current (see, for example, PTL 1). With this manufacturing method, a copper alloy having increased electrical conductivity and increased mechanical strength can be obtained.

CITATION LIST

Patent Literature

PTL 1: WO 2014/069318

SUMMARY OF THE INVENTION

In the copper alloy manufacturing method described in PTL 1, the binary Cu—Zr alloy powder produced from a binary Cu—Zr alloy having a hypoeutectic composition by a high-pressure gas atomization method is subjected to spark plasma sintering (SPS). Disadvantageously, the process for obtaining the raw material powder is complicated. This has led to the desire to produce a copper alloy having increased mechanical strength and increased electrical conductivity using a simpler method.

The present invention has been made in view of the above problem, and a principal object is to provide a copper alloy manufacturing method that allows a copper alloy having increased electrical conductivity and mechanical strength to be produced using a simpler process and to provide this copper alloy.

The present inventors have conducted extensive studies in order to achieve the above principal object and found that a copper alloy having increased electrical conductivity and mechanical strength can be produced by a simpler process when a copper powder and a Cu—Zr master alloy or the copper powder and a $ZrH_2$ powder are used as raw material powders and subjected to spark plasma sintering. Thus, the present invention has been completed.

A method for manufacturing a copper alloy according to the present invention comprises (a) weighing a copper powder and one of a Cu—Zr master alloy and a $ZrH_2$ powder such that an alloy composition of Cu-xZr (x is the atomic % of Zr, and $0.5 \leq x \leq 8.6$ is satisfied) is obtained and pulverizing and mixing the copper powder and the one of the Cu—Zr master alloy and the $ZrH_2$ powder in an inert atmosphere until an average particle diameter D50 falls within the range of from 1 μm to 500 μm to thereby obtain a powder mixture; and (b) subjecting the powder mixture to spark plasma sintering by holding the powder mixture at a prescribed temperature lower than eutectic temperature while the powder mixture is pressurized at a pressure within a prescribed range.

A copper alloy according to the present invention has a structure in which a second phase is dispersed in a α-Cu matrix phase and has the following features (1) to (3):

(1) the average particle diameter D50 of the second phase in cross section is within the range of 1 μm to 100 μm;

(2) the α-Cu matrix phase and the second phase are present as two separate phases, and the second phase contains a Cu—Zr-based compound; and (3) the second phase has an outer shell composed of the Cu—Zr-based compound phase and a core portion including a Zr-rich Zr phase.

The present invention allows a copper alloy having increased electrical conductivity and mechanical strength to be produced by a simpler process. The reason for this may be as follows. Generally, metal powders can be highly reactive, but this depends on the elements of the powders. For example, Zr powder is highly reactive with oxygen and must be handled with extreme care when it is used as a raw material powder in air. However, a Cu—Zr master alloy powder (e.g., a Cu-50 mass % Zr master alloy) and a $ZrH_2$ powder are relatively stable and are easy to handle even in air. Therefore, the above copper alloy can be produced using a relatively simple process including mixing and pulverizing raw materials including such a powder and then subjecting the mixture to spark plasma sintering.

BRIEF DESCRIPTION OF THE DRAWINGS

FIG. 14 shows the results of nano-electron beam diffraction analysis at points 1 and 4.

FIGS. 15A-15C show the results of measurements of hardness H by a nano-indentation method.

FIG. 16 shows the results of measurements of channeling patterns of Kikuchi lines by E3SD in Experimental Example 3-3.

FIGS. 27A and B show the results of a pin-on-disk sliding wear test in Experimental Example 1.

FIGS. 28A-28C show the results of the pin-on-disk sliding wear test in Experimental Examples 3 and 4.

DETAILED DESCRIPTION OF THE INVENTION

Figure 1:
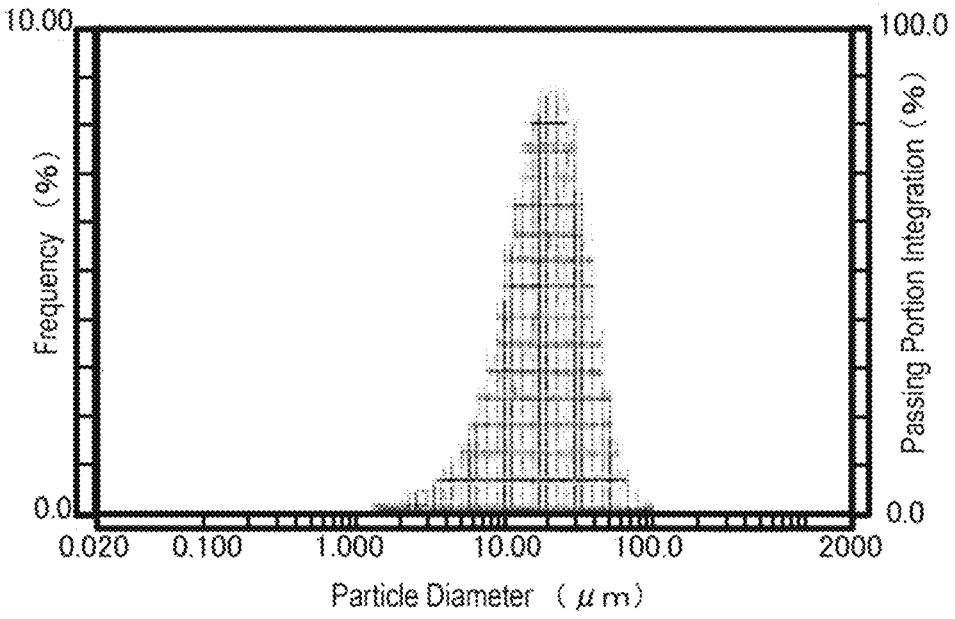
FIG. 1 shows a particle size distribution of a powder mixture in Experimental Example 3.

Next, the method for manufacturing a copper alloy according to the present invention will be described. The method for manufacturing a copper alloy according to the present invention includes (a) a pulverization step of obtaining a raw material powder mixture and (b) a sintering step of subjecting the powder mixture to spark plasma sintering (SPS).

(a) Pulverization Step

In this step, a copper powder and a Cu—Zr master alloy are weighed, or the copper powder and a $ZrH_2$ powder are weighed. Specifically, these are weighed such that an alloy composition of Cu-xZr (x is the atomic % (hereinafter abbreviated as at %) of Zr, and $0.5 \leq x \leq 8.6$ is satisfied) is obtained and are then pulverized and mixed in an inert atmosphere until the average particle diameter D50 falls within the range of from 1 μm to 500 μm to thereby obtain a powder mixture. In this step, the raw materials (the copper powder and the Cu—Zr master alloy, or the copper powder and the $ZrH_2$ powder) may be weighed such that an alloy composition of Cu-xZr (0.5 at $\% \leq x \leq 8.6$ at %) is obtained. The copper powder has an average particle diameter of, for example, preferably 180 μm or less, more preferably 75 μm or less, and still more preferably 5 μm or less. The above average particle diameter is a D50 particle diameter measured using a laser diffraction particle size distribution measurement device. Preferably, the copper powder is composed of copper and inevitable components. More preferably, the copper powder is oxygen-free copper (JIS C1020). Examples of the inevitable components include Be, Mg, Al, Si, P, Ti, Cr, Mn, Fe, Co, Ni, Zn, Sn, Pb, Nb, and Hf. The content of the inevitable components with respect to the total mass may be 0.01% by mass or less. In this step, it is preferable to use a Cu—Zr master alloy containing 50% by mass of Cu as a raw material of Zr. This Cu—Zr alloy is preferable because it is relatively chemically stable and can provide good workability. The Cu—Zr master alloy may be in the form of ingot or metal pieces but is preferably in the form of fine metal particles because it can be easily pulverized and mixed. The Cu—Zr alloy has an average particle diameter of, for example, preferably 250 μm or less and more preferably 20 μm or less. In this step, it is also preferable to use a $ZrH_2$ powder as the raw material of Zr. This $ZrH_2$ powder is preferable because it is relatively chemically stable and can provide good workability in air. The $ZrH_2$ powder has an average particle diameter of, for example, 10 μm or less and more preferably 5 μm or less.

In this step, the above components are mixed at an alloy composition of Cu-xZr (0.5 at $\% \leq x \leq 8.6$ at %), but x may fall within the range of, for example, 5.0 at $\% \leq x \leq 8.6$ at %. When the content of Zr is large, the mechanical strength tends to increase. The alloy composition may be such that x falls within the range of 0.5 at $\% \leq x \leq 5.0$ at %. When the content of Cu is large, the electrical conductivity tends to increase. Specifically, in this step, the above components are mixed at an alloy composition of $Cu_{1-x}Zr_x$ ($0.005 \leq X \leq 0.086$), but X may fall within the range of, for example, $0.05 \leq X \leq 0.086$. When the content of Zr is large, the mechanical strength tends to increase. The alloy composition may be such that X falls within the range of $0.005 \leq X \leq 0.05$. When the content of Cu is large, the electrical conductivity tends to increase. In this step, the copper powder, the Cu—Zr master alloy or the $ZrH_2$ powder, and a grinding medium may be sealed in a closed container and then mixed and pulverized. In this step, it is preferable to mix and pulverize the components using, for example, a ball mill. No particular limitation is imposed on the grinding medium, and the grinding medium may be agate ($SiO_2$), alumina ($Al_2O_3$), silicon nitride ($Si_3N_4$), silicon carbide (SiC), zirconia ($ZrO_2$), stainless steel (Fe—Cr—Ni), chromium steel (Fe—Cr), cemented carbide (WC—Co), etc. From the viewpoint of high hardness, of specific gravity, and of preventing mixing of foreign matter, it is preferable that the grinding medium is Zr balls. The atmosphere inside the closed container is an inert atmosphere such as a nitrogen, He, or Ar atmosphere. The process time for the mixing and pulverization may be determined empirically such that the average particle diameter D50 falls within the range of 1 μm to 500 μm. The process time may be, for example, 12 hours or longer and may be 24 hours or longer. The powder mixture has an average particle diameter D50 of 100 μm or less, more preferably 50 μm or less, and still more preferably 20 μm or less. The smaller the particle diameter of the powder mixture subjected to mixing and pulverization, the more preferable. This is because the copper alloy obtained can be more uniform. The powder mixture obtained by pulverization and mixing may contain, for example, the Cu powder and a Zr powder or may contain a Cu—Zr alloy powder. The powder mixture obtained by pulverization and mixing may be, for example, at least partially alloyed in the course of pulverization and mixing.

(b) Sintering Step

In this step, the powder mixture is subjected to spark plasma sintering by holding the powder mixture at a prescribed temperature lower than eutectic temperature while the powder mixture is pressurized at a pressure within a prescribed range. In step (b), the powder mixture may be inserted into a graphite-made die and subjected to spark plasma sintering in a vacuum. The vacuum condition may be, for example, 200 Pa or less, 100 Pa or less, or 1 Pa or less. In this step, the spark plasma sintering may be performed at a temperature lower by 400° C. to 5° C. than the eutectic temperature (e.g., 600° C. to 950° C.) or at a temperature lower by 272° C. to 12° C. than the eutectic temperature. The spark plasma sintering may be performed at a temperature of 0.9 Tm° C. or lower (Tm (° C.) is the melting point of the alloy powder). The condition for pressurizing the powder mixture may be within the range of from 10 MPa to 100 MPa or within the range of 60 MPa or less. In this manner, a dense copper alloy can be obtained. The holding time under pressure is preferably 5 minutes or longer, more preferably 10 minutes or longer, and still more preferably 15 minutes or longer. The holding time under pressure is preferably within the range of 100 minutes or shorter. As for the spark plasma conditions, it is preferable that a direct current within the range of from 500 A to 2,000 A is supplied between the die and a base plate.

The copper alloy according to the present invention has a structure in which a second phase is dispersed in a Cu matrix phase and has the following features (1) to (3). The copper alloy may further have at least one of features (4) and (5).

(1) The average particle diameter D50 of the second phase in cross section is within the range of 1 μm to 100 μm. (2) The α-Cu matrix phase and the second phase are present as two separate phases, and the second phase contains a Cu—Zr-based compound.

(3) The second phase has an outer shell composed of the Cu—Zr-based compound phase and a core including a Zr-rich Zr phase.

(4) The Cu—Zr-based compound phase serving as the outer shell has a thickness of 40% to 60% of a particle radius which is the distance between a particle outermost circumference and a particle center.

(5) The Cu—Zr-based compound phase serving as the outer shell has a hardness of 585±100 MHv, and the Zr phase serving as the core has a hardness of 310±100 MHv.

The Cu matrix phase is a phase containing Cu and may be, for example, a phase containing α-Cu. The Cu phase can increase electrical conductivity and can also increase processability. The Cu phase contains no eutectic phase. The eutectic phase is a phase containing, for example, Cu and a Cu—Zr-based compound.

In the copper alloy, the average particle diameter D50 of the second phase is determined as follows. First, a back-scattered electron image of a cross section of a specimen is observed at 100× to 500× using a scanning electron microscope (SEM). Then the diameters of inscribed circles of particles in the image are determined and used as the diameters of the particles. Specifically, the diameters of all the particles present in the field of view are determined. This procedure is repeated for a plurality of fields of view (e.g., five fields of view). The particle diameters obtained are used to determine a cumulative distribution, and its median diameter is used as the average particle diameter D50. In this copper alloy, it is preferable that the Cu—Zr-based compound phase contains $Cu_5Zr$. The Cu—Zr-based compound phase may be a single phase or may be a phase containing two or more Cu—Zr-based compounds. The Cu—Zr-based compound phase may be a single phase such as a $Cu_9Zr_2$ phase, a $Cu_5Zr$ phase, or a $Cu_8Zr_3$ phase, may include the $Cu_5Zr$ phase as a main phase and another Cu—Zr-based compound ($Cu_9Zr_2$ or $Cu_8Zr_3$) as a subphase, or may include the $Cu_9Zr_2$ phase as a main phase and another Cu—Zr-based compound ($Cu_5Zr$ or $Cu_8Zr_3$) as a subphase. In the Cu—Zr-based compound phase, the main phase is a phase with the highest abundance (with the largest volume fraction or the largest area fraction in an observation region). The subphase in the Cu—Zr-based compound phase is a phase other than the main phase. The Cu—Zr-based compound phase has, for example, high Young's modulus and high hardness, so that the presence of the Cu—Zr-based compound phase allows the mechanical strength of the copper alloy to be increased.

In the copper alloy, the Zr phase in the second phase may contain Zr in an amount of, for example, 90 at % or more, 92 at % or more, or 94 at % or more. In the second phase, an oxide film may be formed in its outermost shell. The presence of the oxide film may suppress diffusion of Cu into the second phase. In the core of the second phase, many fine distorted particles may form twin crystals. The fine particles may be the Zr phase, and the Cu—Zr-based compound phase may be formed in the distorted portions. With this structure, for example, the electrical conductivity may be further increased, and the mechanical strength may be further increased.

The copper alloy may be formed at a hypoeutectic composition by subjecting a copper powder and a Cu—Zr master alloy or the copper powder and a $ZrH_2$ powder to spark plasma sintering. The spark plasma sintering may be performed using the process described above. The hypoeutectic composition may be, for example, a composition containing from 0.5 at % to 8.6 at % of Zr with the balance being Cu. The copper alloy may contain inevitable components (e.g., a trace amount of oxygen). The content of oxygen is, for example, preferably 700 ppm or less and may be 200 ppm to 700 ppm. Examples of the inevitable components include Be, Mg, Al, Si, P, Ti, Cr, Mn, Fe, Co, Ni, Zn, Sn, Pb, Nb, and Hf. The content of the inevitable components with respect to the total mass may be within the range of 0.01% by mass or less. The copper alloy may have a composition obtained by diluting the composition shown in Table 1 until the content of Zr falls within the range of from 0.5 at % to 8.6 at %.

TABLE 1

| Component | Content (% by mass) |
|---|---|
| Zr | 47.0-49.9 |
| Be | <0.01 |
| Mg | <0.1 |
| Al | <0.01 |
| Si | <0.03 |
| P | <0.01 |
| Ti | <0.1 |
| Cr | <0.1 |
| Mn | <0.1 |
| Fe | <0.05 |
| Co | <0.1 |
| Ni | <0.1 |
| Zn | <0.1 |
| Sn | <0.01 |
| Pb | <0.1 |
| Nb | <0.1 |
| Hf | <0.5 |
| sub-total | <0.7 |
| Cu | bal. |

The copper alloy of the present invention may have a tensile strength of 200 MPa or more. The copper alloy of the present invention may have an electrical conductivity of 20% IACS or more. The tensile strength is a value measured according to JIS-Z2201. The electrical conductivity is determined by measuring the volume resistivity of the copper alloy according to JIS-H0505 and computing the ratio of the volume resistivity of annealed pure copper (0.017241 μΩm) to the measured volume resistivity to convert the volume resistivity to electrical conductivity (% IACS).

The copper alloy in the present embodiment and the manufacturing method therefor have been described above in detail. With this manufacturing method, a copper alloy having increased electrical conductivity and mechanical strength can be produced using a simpler process. The reason for this may be as follows. Generally, metal powders can be high reactive with oxygen, but this depends on the elements of the powders. For example, Zr powder is highly reactive and must be handled with extreme care when it is used as a raw material powder in air, in order to avoid danger such as an explosion. However, the Cu—Zr master alloy powder (e.g., a Cu-50 mass % Zr master alloy) and the $ZrH_2$ powder are relatively stable and are easy to handle. The copper alloy having increased electrical conductivity and mechanical strength can be produced using a relatively simple process including mixing and pulverizing raw materials including such a powder and then subjecting the mixture to spark plasma sintering. When this copper alloy is used for, for example, discharge electrodes or sliding components, these can have a low friction coefficient and are stable, and abrasion loss and weight loss can be reduced.

The present invention is not limited to the embodiments described above. It will be appreciated that the present invention can be embodied in various forms so long as they fall within the technical scope of the invention.

EXAMPLES

Experimental Examples, which are examples in which specific copper alloys were produced, will be described below. Experimental Examples 3-1 to 3-3 and 4-1 to 4-3 correspond to Examples of the present invention, and Experimental Examples 1-1 to 1-3 and 2-1 to 2-3 correspond to Reference Examples.

Experimental Example 1 (1-1 to 1-3)

Cu—Zr-based alloy powders produced by a high-pressure Ar gas atomization method for pulverization were used. The average particle diameters D50 of these alloy powders were 20 to 28 μm. The contents of Zr in the Cu—Zr-based alloy powders were 1 at %, 3 at %, and 5 at %, respectively, and the Cu—Zr-based alloy powders were used as alloy powders in Experimental Examples 1-1 to 1-3, respectively. The particle size of each of the alloy powders was measured using a laser diffraction particle size distribution measurement device (SALD-3000J) manufactured by Shimadzu Corporation. The content of oxygen in each powder was 0.100 mass %. The SPS (spark plasma sintering) used as the sintering step was performed using a spark plasma sintering apparatus (Model: SPS-210LX) manufactured by SPS Syntex, Inc. 40 g of one of the powders was placed in a graphite-made die having a cavity of a diameter of 20 mm×10 mm, and a DC pulse current of 3 kA to 4 kA was supplied under the conditions of a temperature rise rate of 0.4 K/s, a sintering temperature of 1,173K (about 0.9 Tm, Tm: the melting point of the alloy), a holding time of 15 minutes, and a pressure of 30 MPa. Each of the copper alloys (SPS materials) in Experimental Examples 1-1 to 1-3 was produced in the manner described above. The copper alloys produced in this manner are collectively referred to as a "copper alloy in Experimental Example 1."

Experimental Example 2 (2-1 to 2-3)

A commercial Cu powder (average particle diameter D50=33 μm) and a commercial Zr powder (average particle diameter D50=8 μm) were used to prepare Cu—Zr-based alloy powders in Experimental Examples 2-1 to 2-3. Specifically, the Cu and Zr powders were mixed such that the contents of Zr in the alloy powders were 1 at %, 3 at %, and 5 at %, respectively. Each of the alloy powders was subjected to CIP forming under the conditions of 20° C. and 200 MPa and then subjected to the same step as in Experimental Example 1. Each of the copper alloys obtained was used as a copper alloy in Experimental Example 2 (2-1 to 2-3). In Experimental Example 2, the entire process was performed in an Ar atmosphere.

Experimental Example 3 (3-1 to 3-3)

Figure 2A:
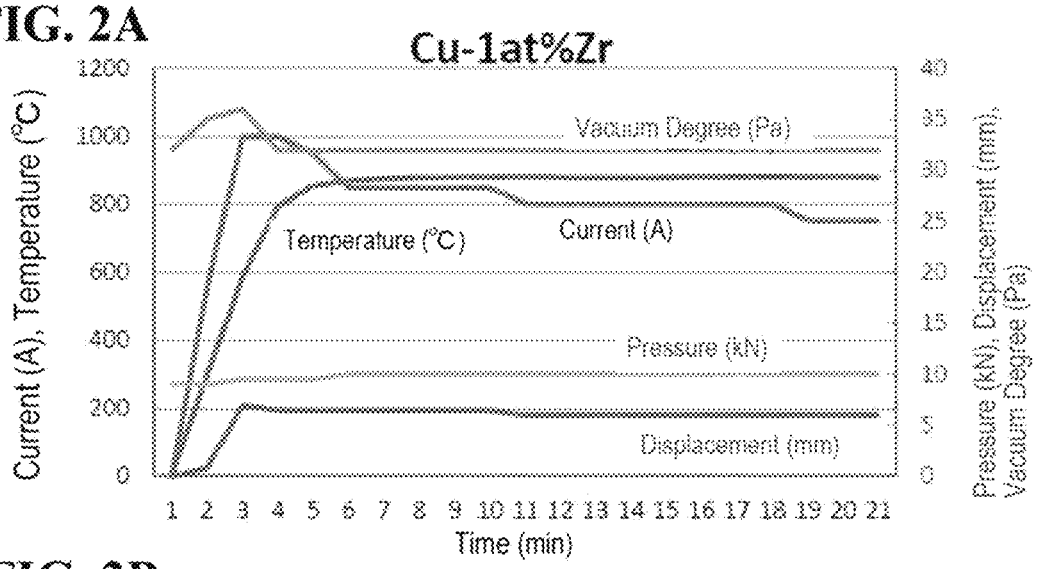
FIGS. 2A-2C show illustrations of SPS conditions in Experimental Example 3.
Figure 2B:
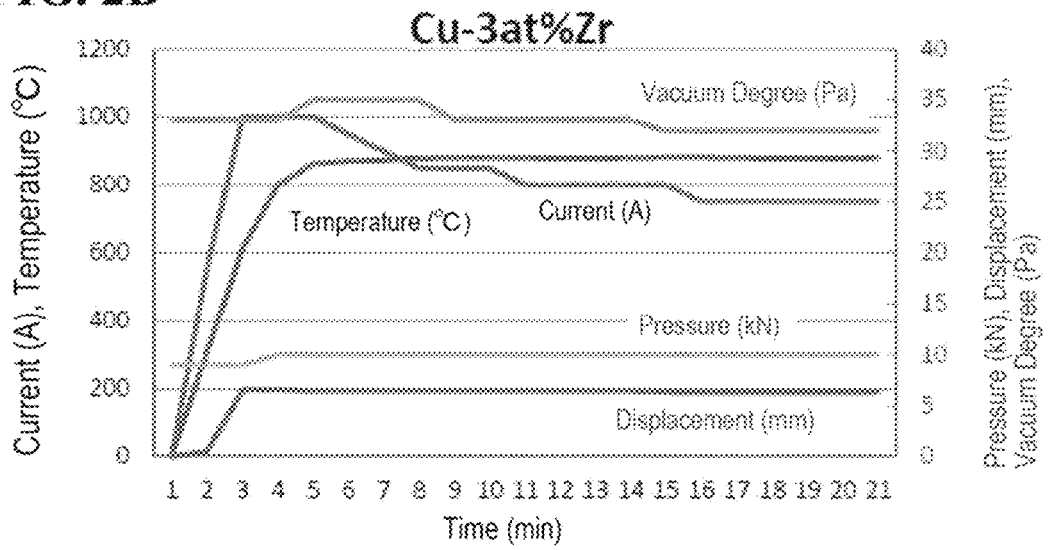
Figure 2C:
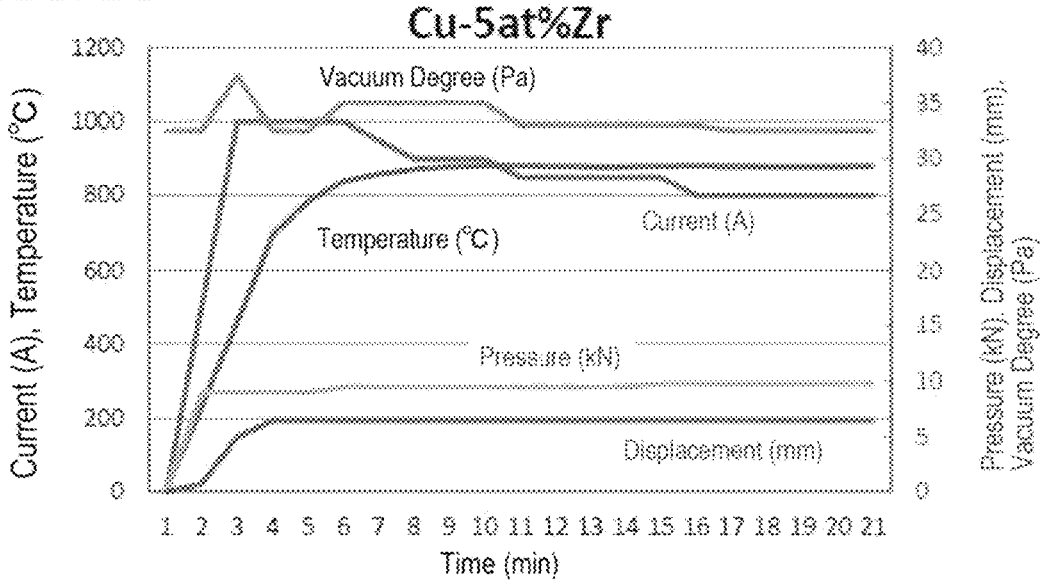

A commercial Cu powder (average particle diameter D50=1 μm) and a commercial Cu-50% by mass Zr alloy were mixed and pulverized in a ball mill with Zr balls for 24 hours. The average particle diameter D50 of the powder obtained was 18.7 μm. FIG. 1 shows the particle size distribution of the powder mixture in Experimental Example 3. Cu—Zr-based alloy powders were prepared such that the contents of Zr were 1 at %, 3 at %, and 5 at %, respectively, and were used as alloy powders in Experimental Examples 3-1 to 3-3. These powders were subjected to the same step as in Experimental Example 1, and each of the copper alloys obtained was used as a copper alloy in Experimental Example 3 (3-1 to 3-3). FIGS. 2A-2C show illustrations of the SPS conditions in Experimental Example 3.

Experimental Example 4 (4-1 to 4-3)

A commercial Cu powder (average particle diameter D50=1 μm) and a commercial $ZrH_2$ powder (average particle diameter D50=5 μm) were mixed and pulverized in a ball mill with Zr balls for 4 hours. The powder obtained was used to prepare Cu—Zr-based alloy powders such that the contents of Zr were 1 at %, 3 at %, and 5 at %, respectively, and were used as alloy powders in Experimental Examples 4-1 to 4-3. These powders were subjected to the same step as in Experimental Example 1, and each of the copper alloys obtained was used as a copper alloy in Experimental Example 4 (4-1 to 4-3).

(Microstructural Observation)

Microstructural observation was performed using a scanning electron microscope (SEM), a scanning transmission electron microscope (STEM), and a nano-beam electron diffraction (NBD) method. The SEM observation was performed using S-5500 manufactured by Hitachi High-Technologies, and a secondary electron image and a backscattered electron image were taken at an acceleration voltage of 2.0 kV. The TEM observation was performed using JEM-2100F manufactured by JEOL Ltd. In this case, a BF-STEM image and a HAADF-STEM image were taken at an acceleration voltage of 200 kV, and nano-electron beam diffraction was performed. Elementary analysis by EDX (JED-2300T manufactured by JEOL Ltd.) was performed as needed. A measurement specimen was prepared by ion-milling at an acceleration voltage of 5.5 kV using a cross section polisher (CP) SM-09010 manufactured by JEOL Ltd. with an argon ion source.

(XRD Measurement)

Compound phases were identified by an X-ray diffraction method using Co-Kα radiation. RINT RAPID II manufactured by Rigaku Corporation was used for the XRD measurement.

(Evaluation of Electric Properties)

The electric properties of the obtained SPS materials in the Experimental Examples were examined at room temperature by probe-type electrical conductivity measurement and four-terminal electrical resistance measurement at a length of 500 mm. The electrical conductivity of a copper alloy was determined by measuring the volume resistivity of the copper alloy according to JIS H0505 and computing the ratio of the volume resistivity of annealed pure copper (0.017241 μΩm) to the measured volume resistivity to convert the volume resistivity to electrical conductivity (% IACS). The following formula was used for the conversion.

$$\text{Electrical conductivity } \gamma(\%\ \text{IACS}) = 0.017241/\text{volume resistivity } \rho \times 100$$

(Evaluation of Properties of Cu—Zr-Based Compound Phases)

For each of the Cu—Zr-based compound phases contained in the copper alloys in Experimental Example 3, the Young's modulus E and the hardness H by the nano-indentation method were measured. The measurement apparatus used was Nano Indenter XP/DCM manufactured by Agilent Technologies. The indenter head used was XP, and a diamond Berkovich indenter was used. Test Works 4 manufactured by Agilent Technologies was used as analysis software. The measurement conditions were as follows: measurement mode: CSM (Continuous Stiffness Measurement), excitation vibration frequency: 45 Hz, excitation vibration amplitude: 2 nm, strain rate: 0.05 $s^{-1}$, indentation depth: 1,000 nm, the number of measurement points N: 5, measurement point interval: 5 μm, measurement temperature: 23° C., and standard sample: fused silica. A sample was subjected to cross-section processing using a cross section polisher (CP). The sample was then fixed to a sample stage using a hot-melt adhesive by heating them at 100° C. for 30 seconds. The sample fixed to the sample stage was attached to the measurement apparatus to measure the Young's modulus E of the Cu—Zr-based compound phase and its hardness H by the nano-indentation method. In this case, each of the Young's modulus E and the hardness H by the nano-indentation method was the average of five measurements.

(Results and Discussion)

Figure 3A:
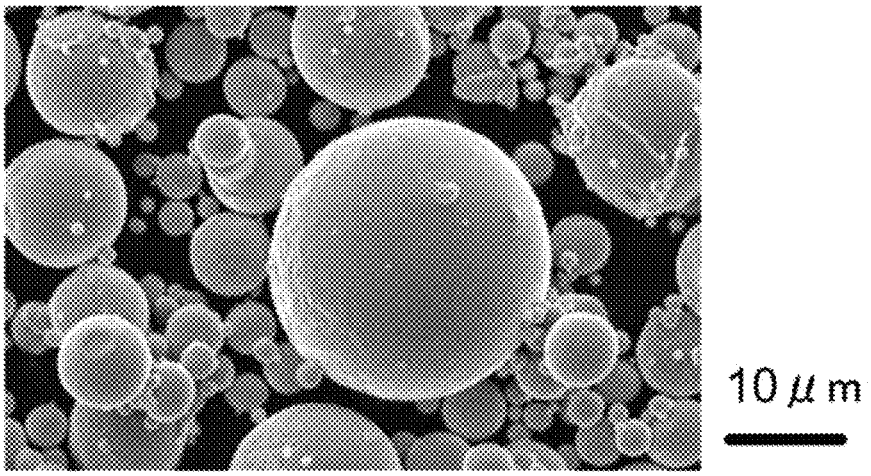
FIGS. 3A-3C show SEM images of raw material powders in Experimental Examples 1-3, 3-3, and 4-3.
Figure 3B:
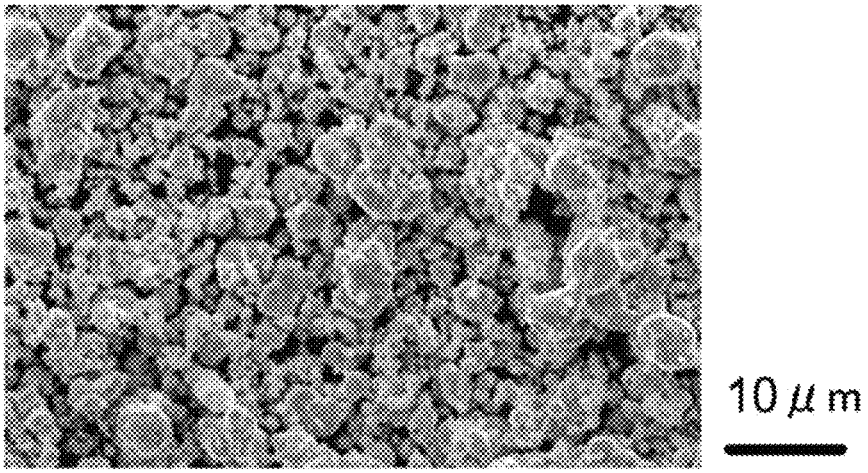
Figure 3C:
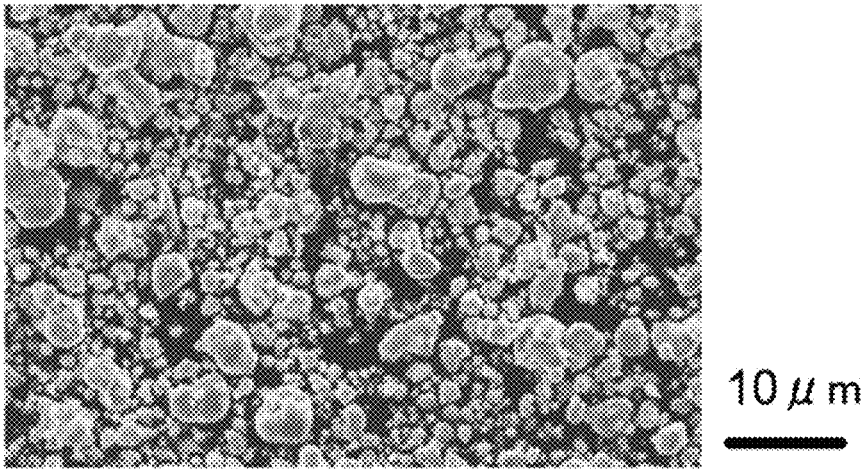
Figure 4:
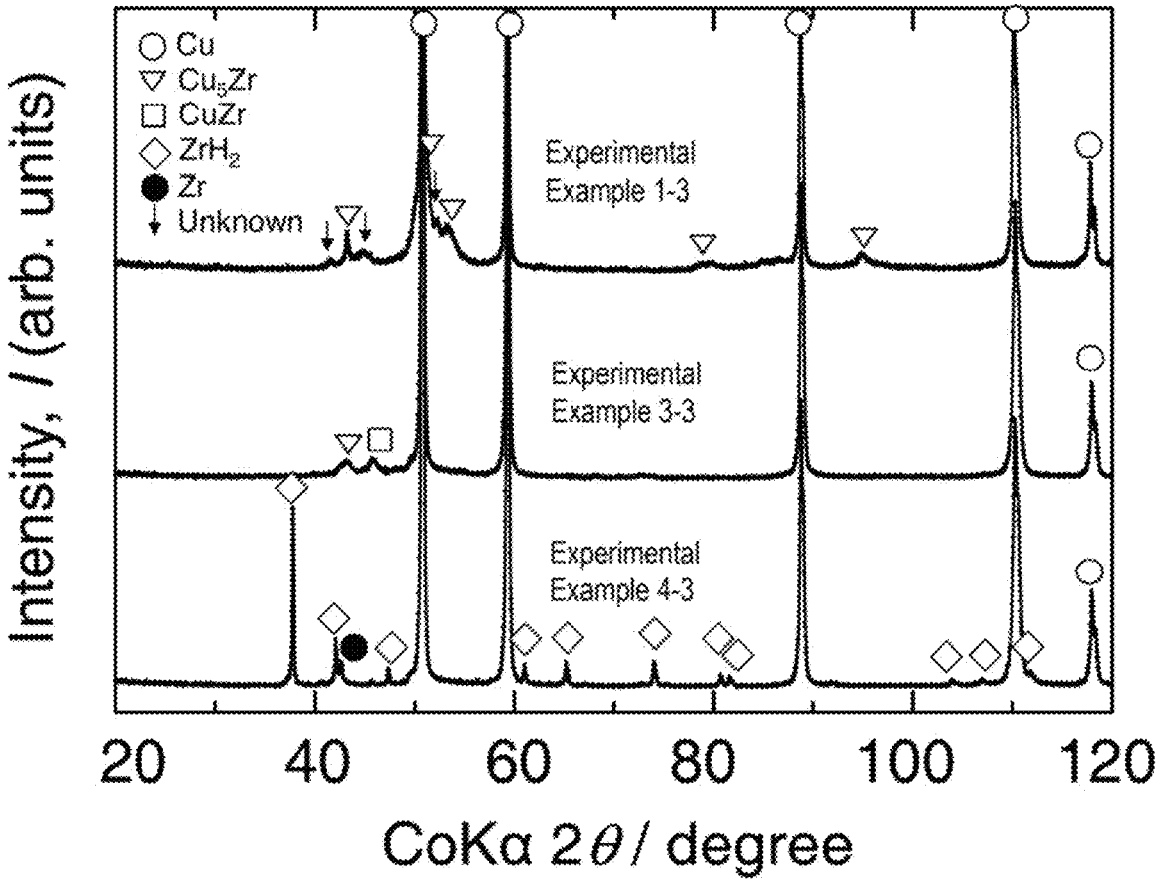
FIG. 4 shows the results of X-ray diffraction measurements on the raw material powders in Experimental Examples 1-3, 3-3, and 4-3.

First, the raw materials were examined. FIG. 3A shows an SEM image of the raw material powder in Experimental Example 1-3, FIG. 3B shows an SEM image of the raw material powder in Experimental Example 3-3, and FIG. 3C shows an SEM image of the raw material powder in Experimental Example 4-3. The raw material powder in Experimental Example 1-3 was spherical. In the raw material powders in Experimental Examples 3-3 and 4-3, coarse teardrop-shaped Cu powder and fine spherical CuZr or $ZrH_2$ powder coexisted. FIG. 4 shows the results of X-ray diffraction measurements on the raw material powders in Experimental Examples 1-3, 3-3, and 4-3. In the raw material powder in Experimental Example 1-3, a Cu phase, a $Cu_5Zr$ compound phase, and an unknown phase were present. In the raw material powder in Experimental Example 3-3, a Cu phase, a CuZr compound phase, and a $Cu_5Zr$ compound phase were present. In the raw material powder in Experimental Example 4-3, a multiphase structure including a Cu phase, a $ZrH_2$ phase, and an α-Zr phase was present. These powders were used to produce the SPS materials examined.

Figure 5:
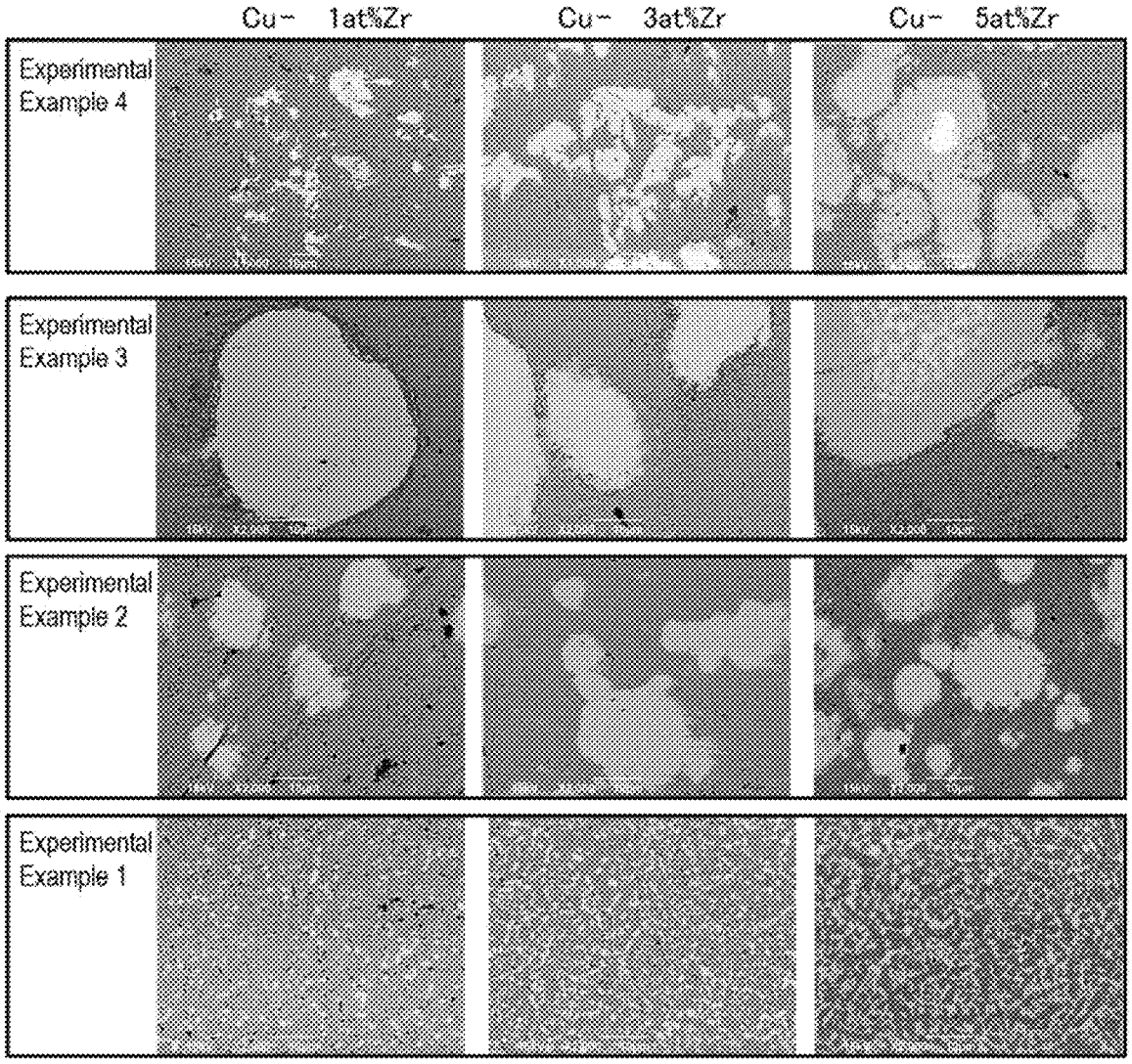
FIG. 5 shows cross-sectional SEM-BEI images in Experimental Examples 1 to 4.
Figure 6:
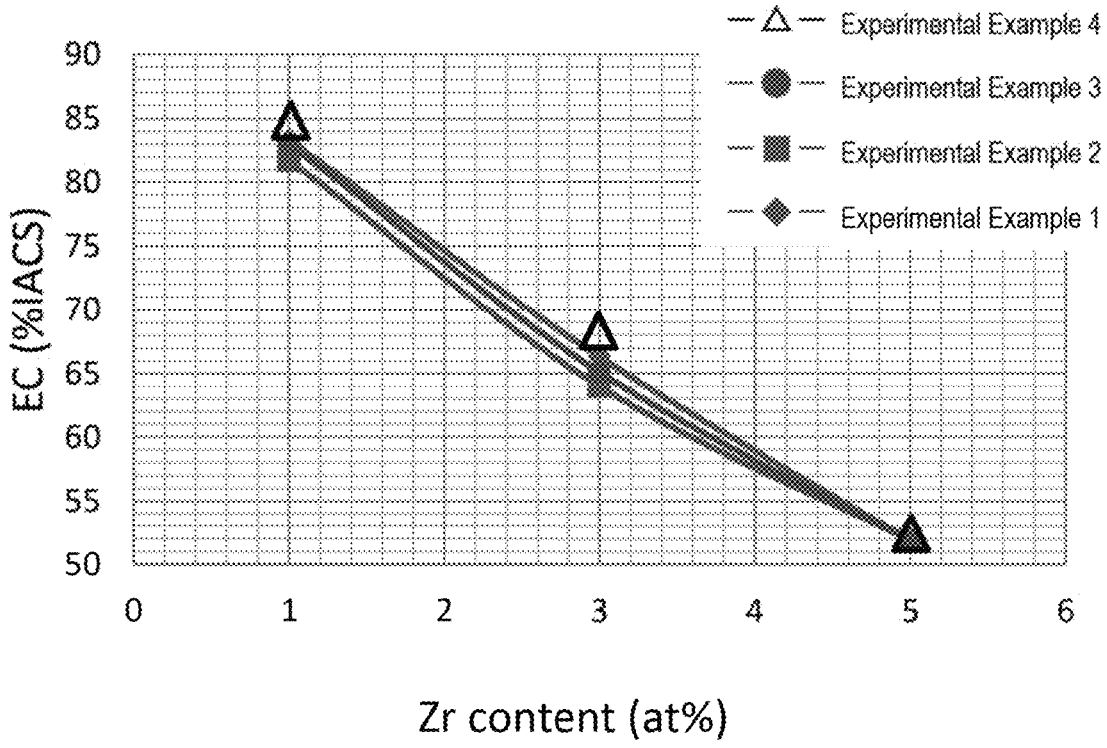
FIG. 6 shows the results of electrical conductivity measurements on copper alloys in Experimental Examples 1 to 4.
Figure 7:
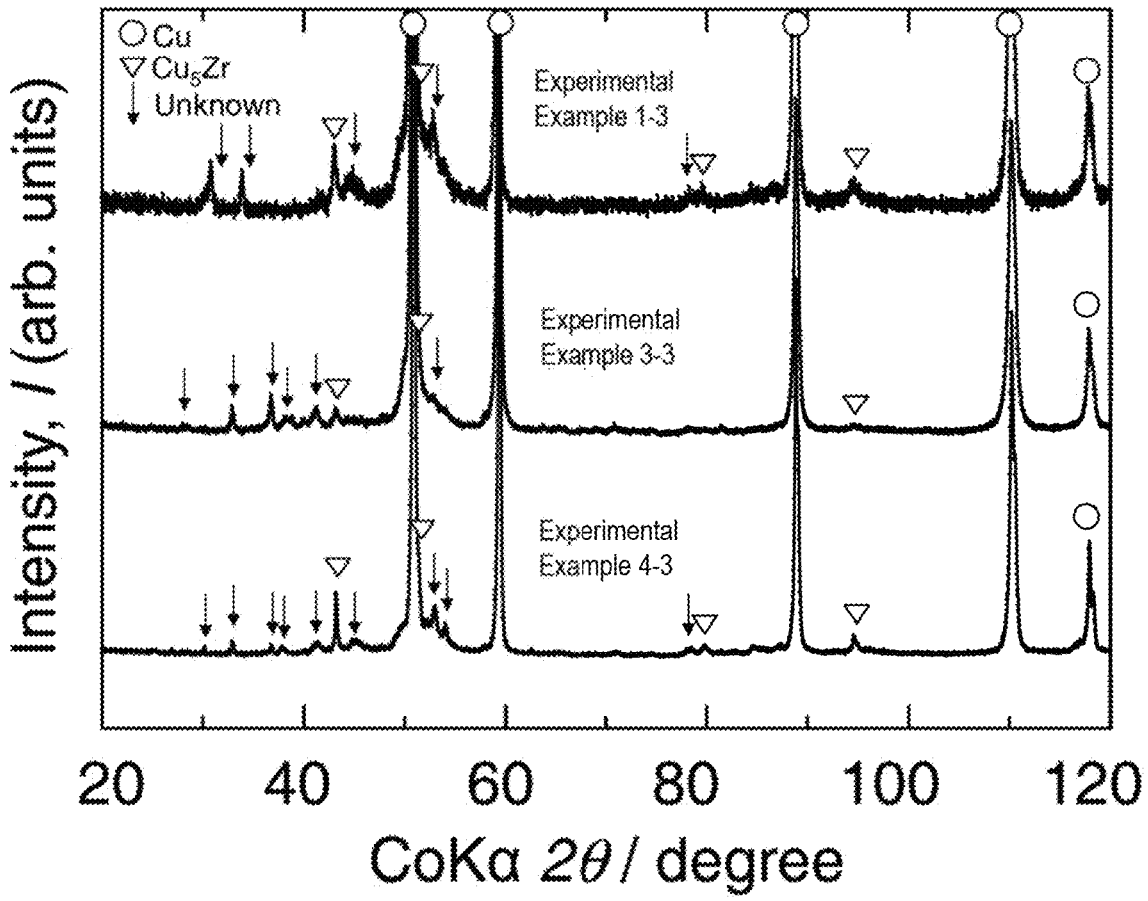
FIG. 7 shows the results of X-ray diffraction measurements in Experimental Examples 1-3, 3-3, and 4-3.

FIG. 5 shows cross-sectional SEM-BEI images in Experimental Examples 1 to 4. Each structure in Experimental Example 1 contained two phases, i.e., the Cu phase and the Cu—Zr-based compound phase (mainly the $Cu_5Zr$ phase), and contained no eutectic phase, and crystals with a size of 10 μm or less in cross section were dispersed in the structure. In Experimental Example 1, the particle diameter of the Cu—Zr-based compound in cross section was small, and the structures were relatively uniform. In each of the structures in Experimental Examples 2 to 4, a relatively large second phase was dispersed in the α-Cu matrix phase. FIG. 6 shows the results of electrical conductivity measurements on the copper alloys in Experimental Examples 1 to 4. The copper alloys in Experimental Examples 1 to 4 had different structures as described above. However, no large difference in tendency of electrical conductivity versus the content of Zr was found for the copper alloys in Experimental Examples 1 to 4. This may be because the electrical conductivities of the copper alloys depend on their Cu phases and there in no structural difference among the Cu phases. The mechanical strength of a copper alloy may depend on its Cu—Zr-based compound phase. Since a Cu—Zr-based compound phase is present in each of Experimental Examples 2 to 4, it is inferred that the value of the mechanical strength is relatively high in each of Experimental Examples 2 to 4. FIG. 7 shows the results of X-ray diffraction measurements in Experimental Examples 1-3, 3-3, and 4-3. As shown in FIG. 7, in each of Experimental Examples 1, 3, and 4, an α-Cu phase, a $Cu_5Zr$ compound phase, and an unknown phase were detected, and it was inferred that a complex structure including these phases was present. This shows that, even when different starting powder materials were used, the structures of the SPS materials were the same. The structures of the SPS materials in Experimental Examples 1-1, 1-2, 3-1, 3-2, 4-1, and 4-2 were the same as the multiphase structure of the SPS materials shown in FIG. 7, although the X-ray diffraction intensities were different for different Zr contents.

Figure 8:
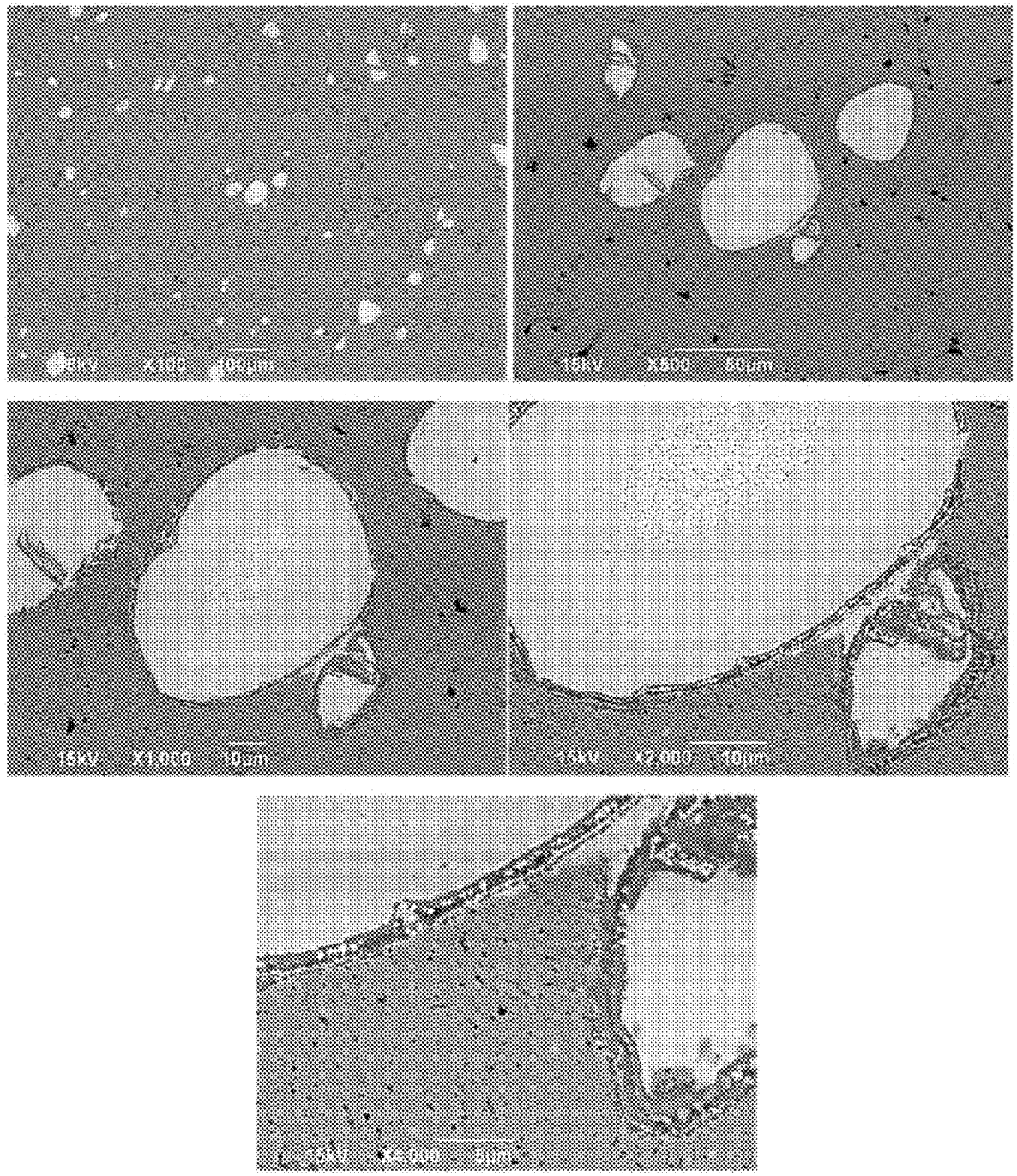
FIG. 8 shows cross-sectional SEM-BEI images in Experimental Example 3-1.
Figure 9:
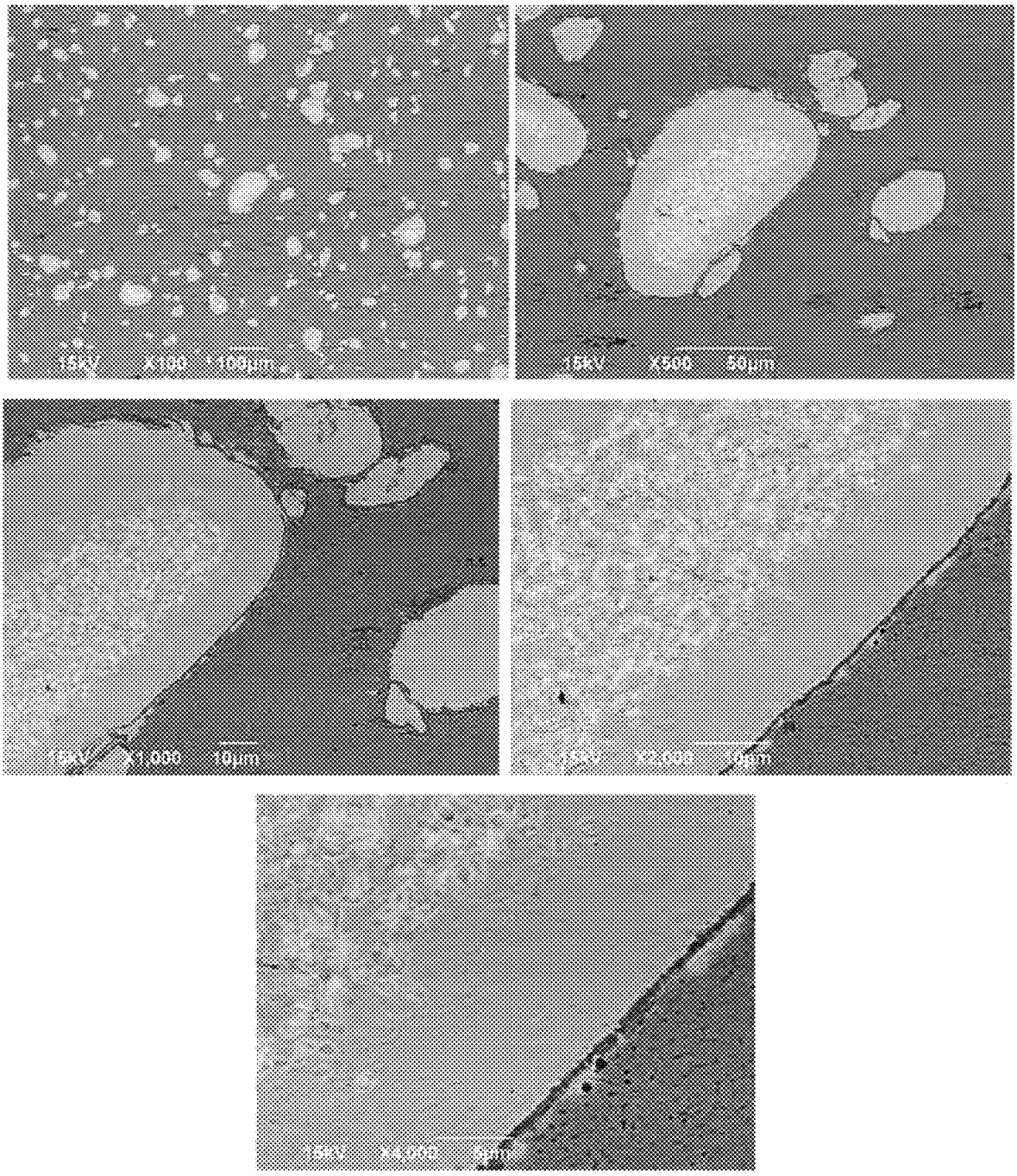
FIG. 9 shows cross-sectional SEM-BEI images in Experimental Example 3-2.
Figure 10:
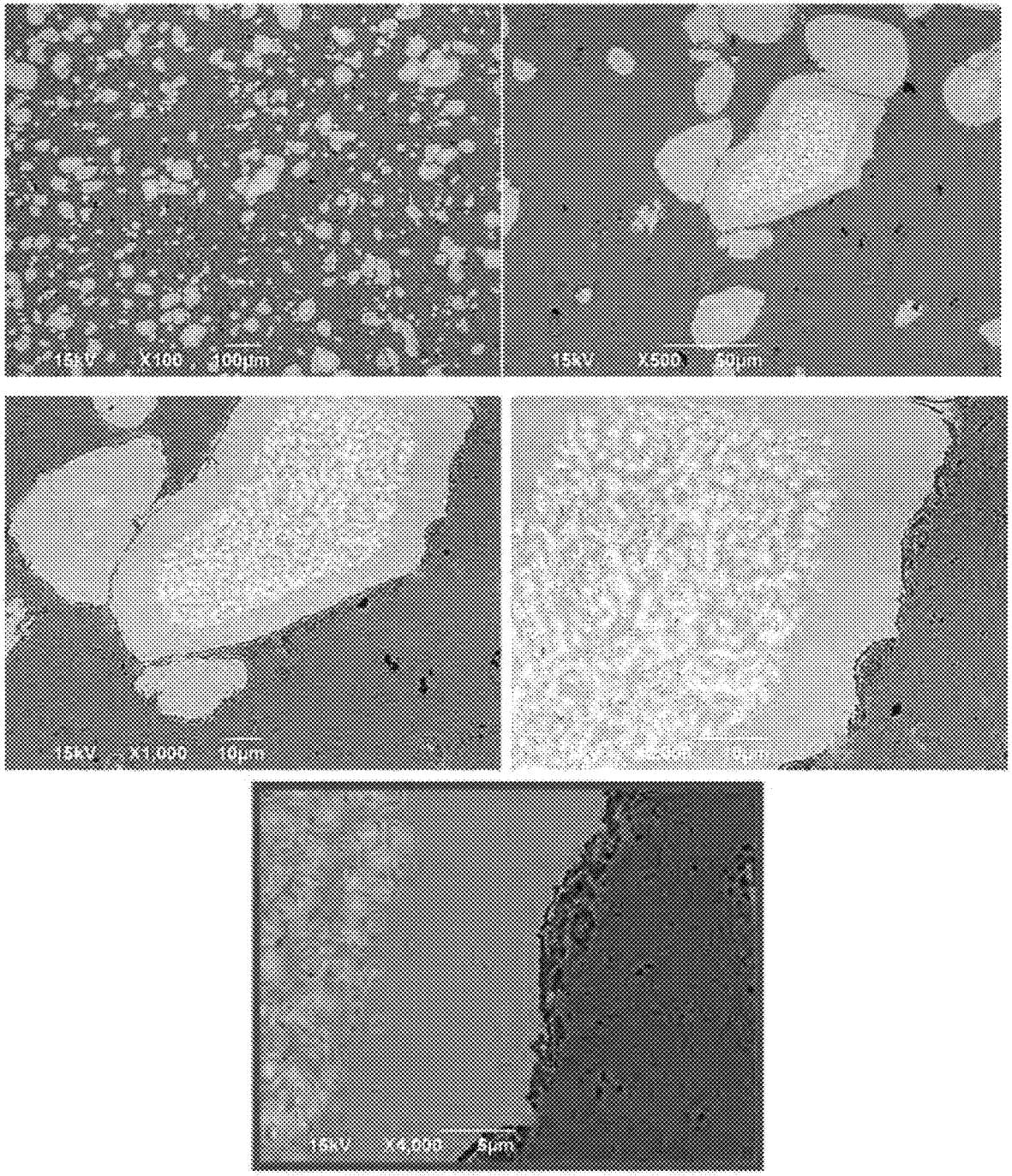
FIG. 10 shows cross-sectional SEM-BEI images in Experimental Example 3-3.
Figure 11:
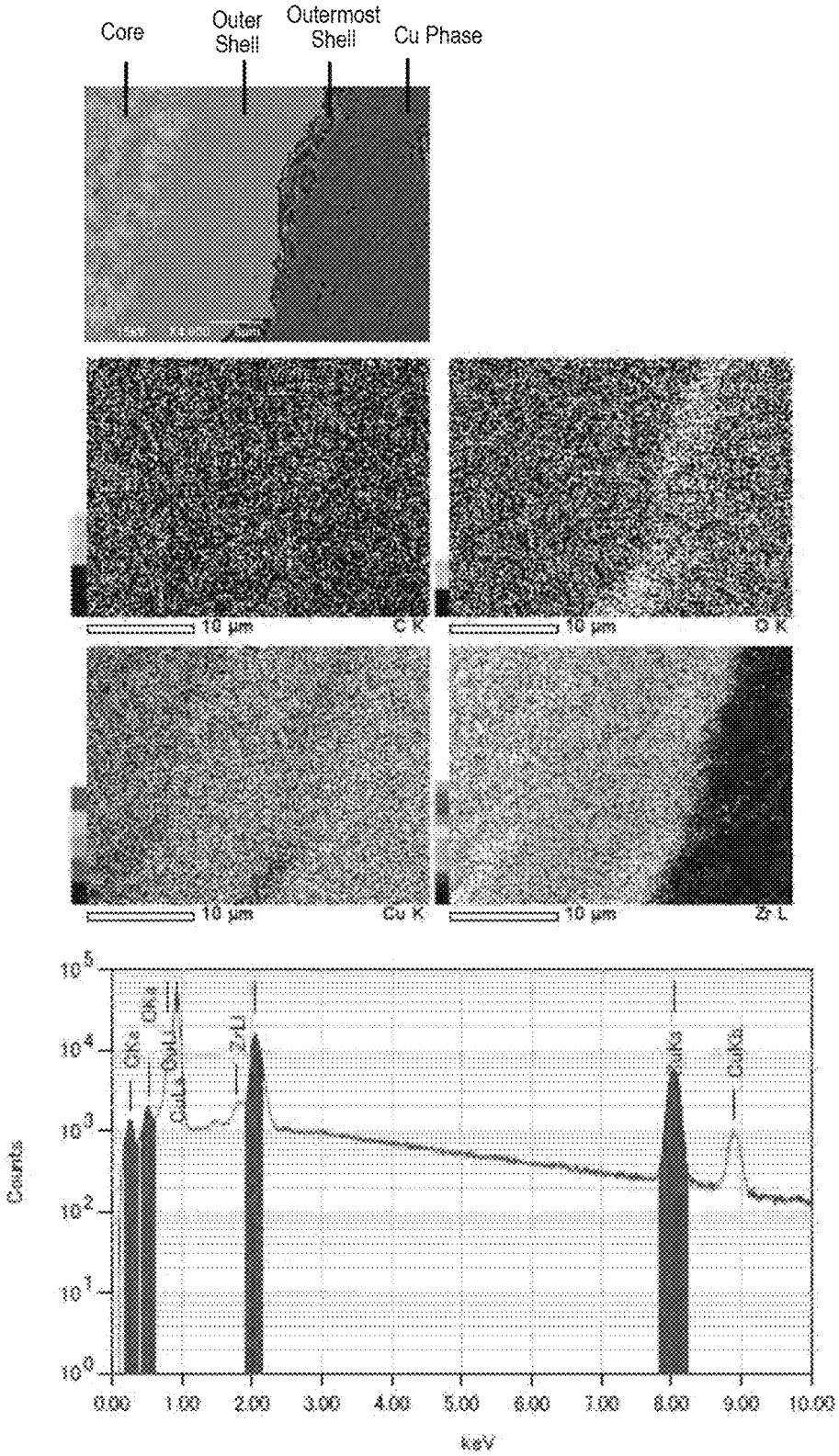
FIG. 11 shows a cross-sectional SEM-BEI image and the results of EDX measurements in Experimental Example 3-3.
Figure 12:
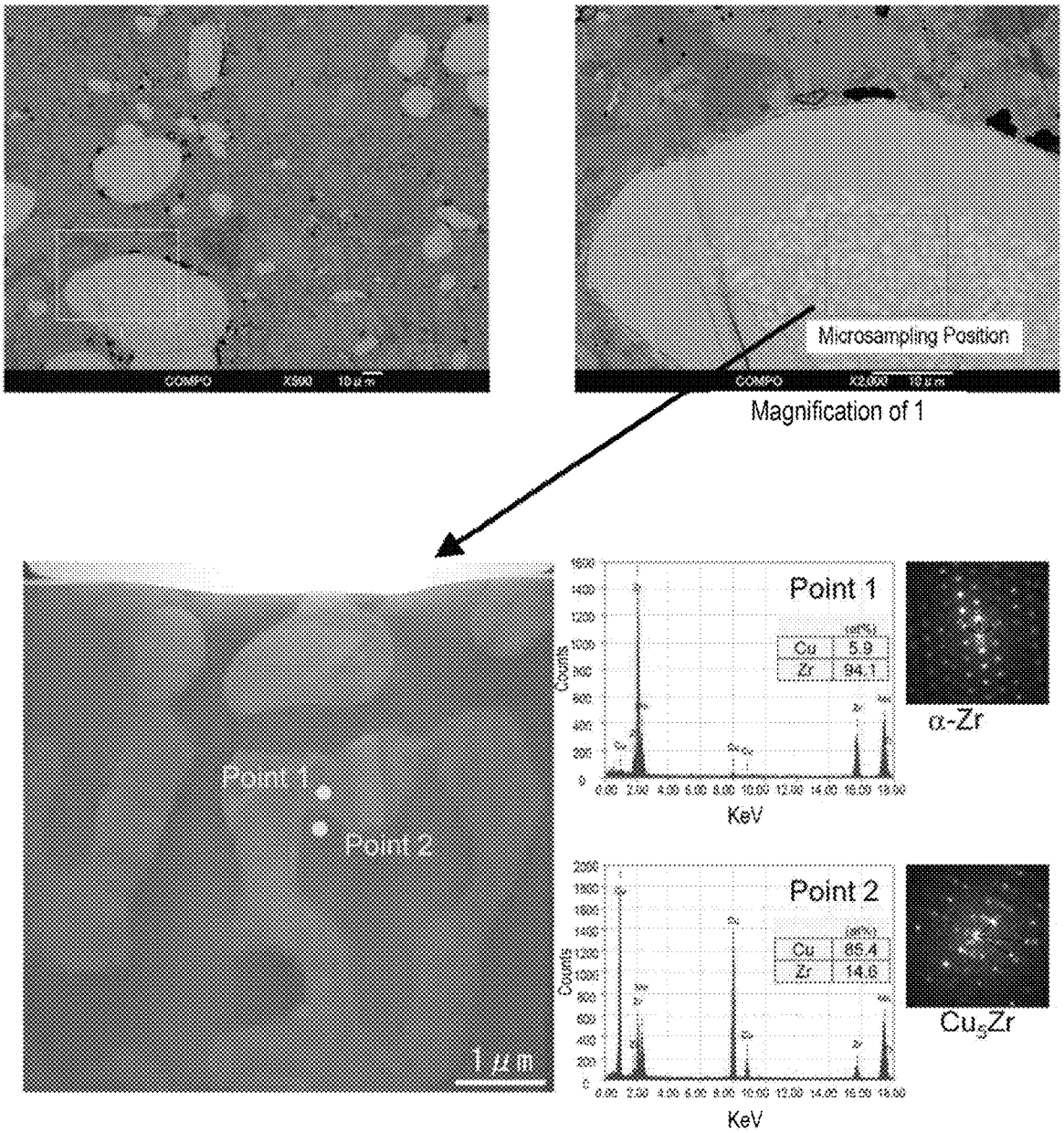
FIG. 12 shows cross-sectional SEM-BEI images, a cross-sectional STEM-BF image, the results of EDX measurements, and NBD patterns in Experimental Example 3-3.
Figure 13:
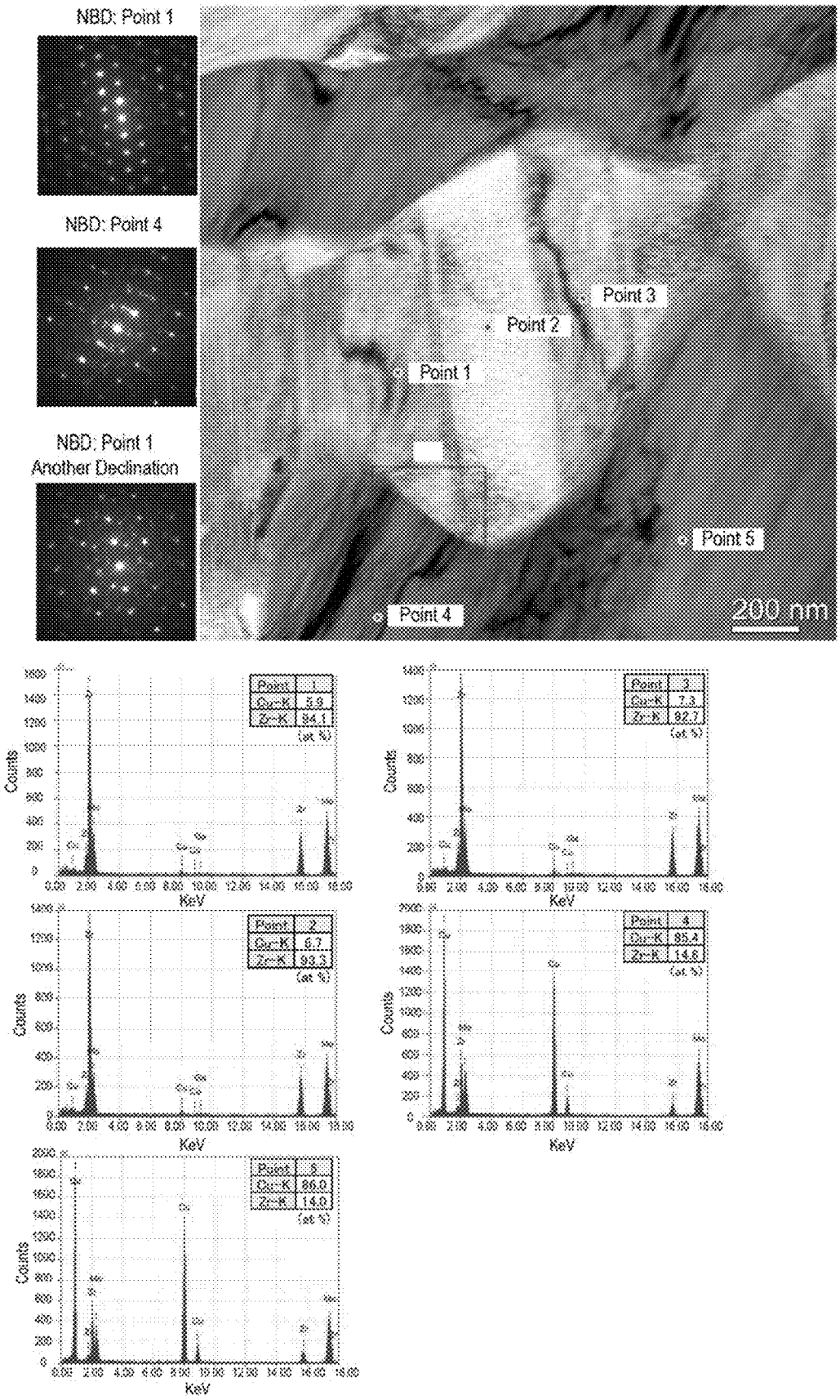
FIG. 13 shows a cross-sectional STEM-BF image, the results of EDX analysis, and NBD patterns in Experimental Example 3-3.

Next, Experimental Example 3 was examined in detail. FIG. 8 shows cross-sectional SEM-BEI images in Experimental Example 3-1. FIG. 9 shows cross-sectional SEM-BEI images in Experimental Example 3-2. FIG. 10 shows cross-sectional SEM-BEI images in Experimental Example 3-3. The average particle diameters D50 of the second phase in the SEM photographs taken were determined. The average particle diameters of the second phase were determined as follows. A backscattered electron image was observed at 100× to 500×, and the diameters of inscribed circles of particles in the image were determined and used as the diameters of the particles. Specifically, the diameters of all the particles present in the field of view were determined. This procedure was repeated for five fields of view. The particle diameters obtained were used to determine a cumulative distribution, and its median diameter was used as the average particle diameter D50. As shown in the SEM photographs in FIGS. 8 to 10, in each of the copper alloys in Experimental Example 3, the average particle diameter D50 of the second phase in cross section was within the range of 1 μm to 100 μm. It was inferred that, in the second phase, an oxide film was formed in the outermost shell of each coarse particle. It was found that, in the core of the second phase, many distorted particles formed twin crystals. FIG. 11 shows a cross-sectional SEM-BEI image and the results of EDX measurements in Experimental Example 3-3. FIG. 12 shows cross-sectional SEM-BEI images, a cross-sectional STEM-BF image, the results of EDX analysis, and NBD patterns in Experimental Example 3-3. FIG. 13 shows a cross-sectional STEM-BF image, the results of EDX analysis, and NBD patterns in Experimental Example 3-3.

The results of the elementary analysis showed that the second phase had: an outer shell composed of a Cu—Zr-based compound phase containing $Cu_5Zr$; and a core including a Zr-rich Zr phase containing 10 at % or less of Cu. FIG. 14 shows the results of nano-electron beam diffraction analysis at points 1 and 4 shown in FIG. 13. As shown in FIG. 13, in a light color fine particle, Zr was 94 at %, and this particle was found to be the Zr phase. In a color striped portion, Cu was 85 at %, and Zr was 15 at %. This portion was expected to be the $Cu_5Zr$ phase. As shown in FIG. 13, points 1 to 3 were expected to be the Zr phase containing at least 92 at % of Zr, and points 4 and 5 were expected to be the $Cu_5Zr$ phase. Judging from the results of the nano-electron beam diffraction and the elementary analysis shown FIG. 14, the Zr phase at point 1 may be an α-Zr phase. Point 4 was confirmed to be the $Cu_5Zr$ phase.

FIGS. 15A-15C show the results of measurements of hardness H by a nano-indentation method. The Young's modulus E and the hardness H were measured at multiple points. After the measurements, measurement points indented into the Zr phase were selected by SEM observation. The Young's modulus E and the hardness H by the nano-indentation method were determined from the measurement results. The average Young's modulus of the Zr phase was 75.4 GPa, and the average hardness H was 3.37 GPa (=311 MHv in terms of Vickers hardness). The Young's modulus E of the Cu—Zr-based compound phase was 159.5 GPa as described later, and its hardness H was 6.3 GPa (=585 MHv in terms of Vickers hardness). These values were different from those of the Zr phase. For the conversion to Vickers hardness, MHv=0.0924×H was used (ISO 14577-1 Metallic Materials-Instrumented Indentation Test for Hardness and Materials Parameters—Part 1: Test Method, 2002).

Figure 17:
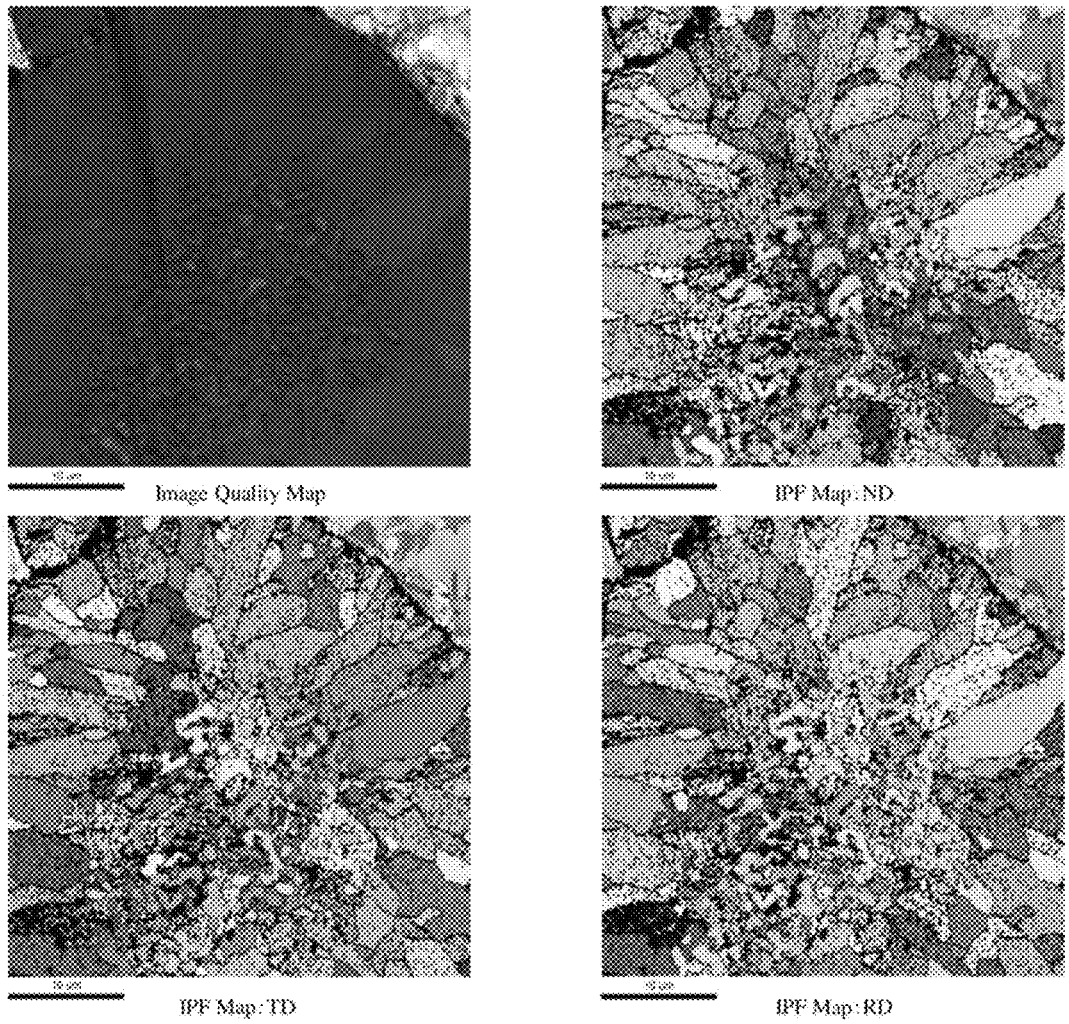
FIG. 17 shows crystal orientation maps by the EBSD method in Experimental Example 3-3.
Figure 18:
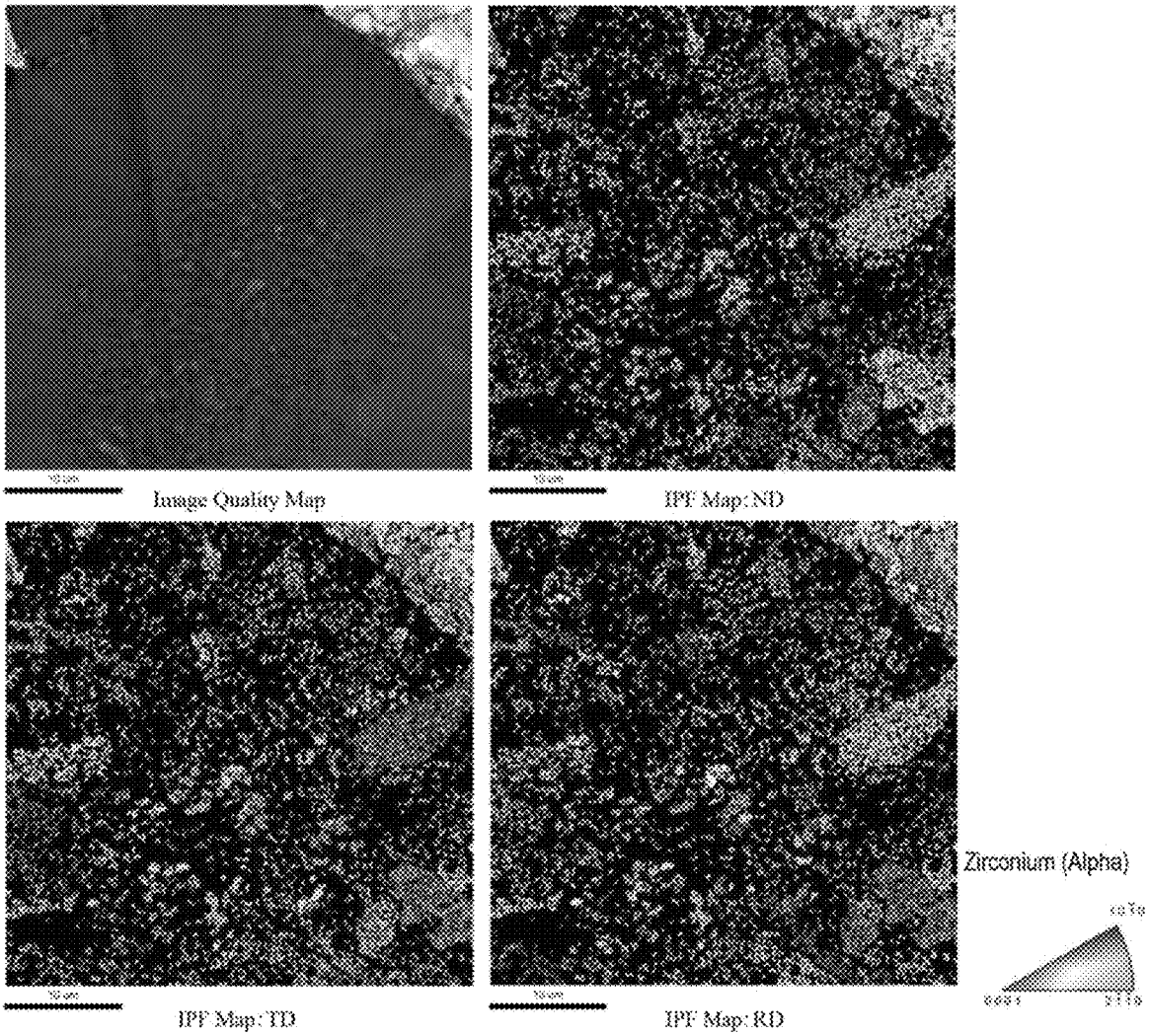
FIG. 18 shows crystal orientation maps by the EBSD method in Experimental Example 3-3.

FIG. 16 shows the results of EBSD analysis in Experimental Example 3-3. FIG. 16 shows the results at point 1 (the Cu—Zr-based compound phase in the second phase) in an SEM image, point 2 (the Zr-rich Zr phase inside the Cu—Zr-based compound phase) in the SEM image, and point 3 (the Zr-rich Zr phase inside the Cu—Zr-based compound phase at a different region) in the SEM image. FIG. 16 also shows the results of crystal structure fitting for point 2 using the channeling pattern of Kikuchi lines. Different patterns were observed at points 1, 2, and 3, and the crystal orientations at these points were different from each other. The fitting results showed that the crystal structure of the Zr phase did not agree with the face-centered cubic lattice (FCC), the hexagonal close-packed lattice (HCP), and the body-centered cubic lattice (BCC) and was an imperfect structure containing a small amount of Cu. FIGS. 17 and 18 show crystal orientation maps by the EBSD method in Experimental Example 3-3. The crystal orientation maps were displayed using OIM (Orientation Imaging Microscopy) software manufactured by TSL Solutions. These results showed that the Zr-rich Zr phase was not present as an independent region containing the Cu—Zr-based compound phase therearound but had a structure in which the Zr phase was interspersed in the compound phase.

Figure 19:
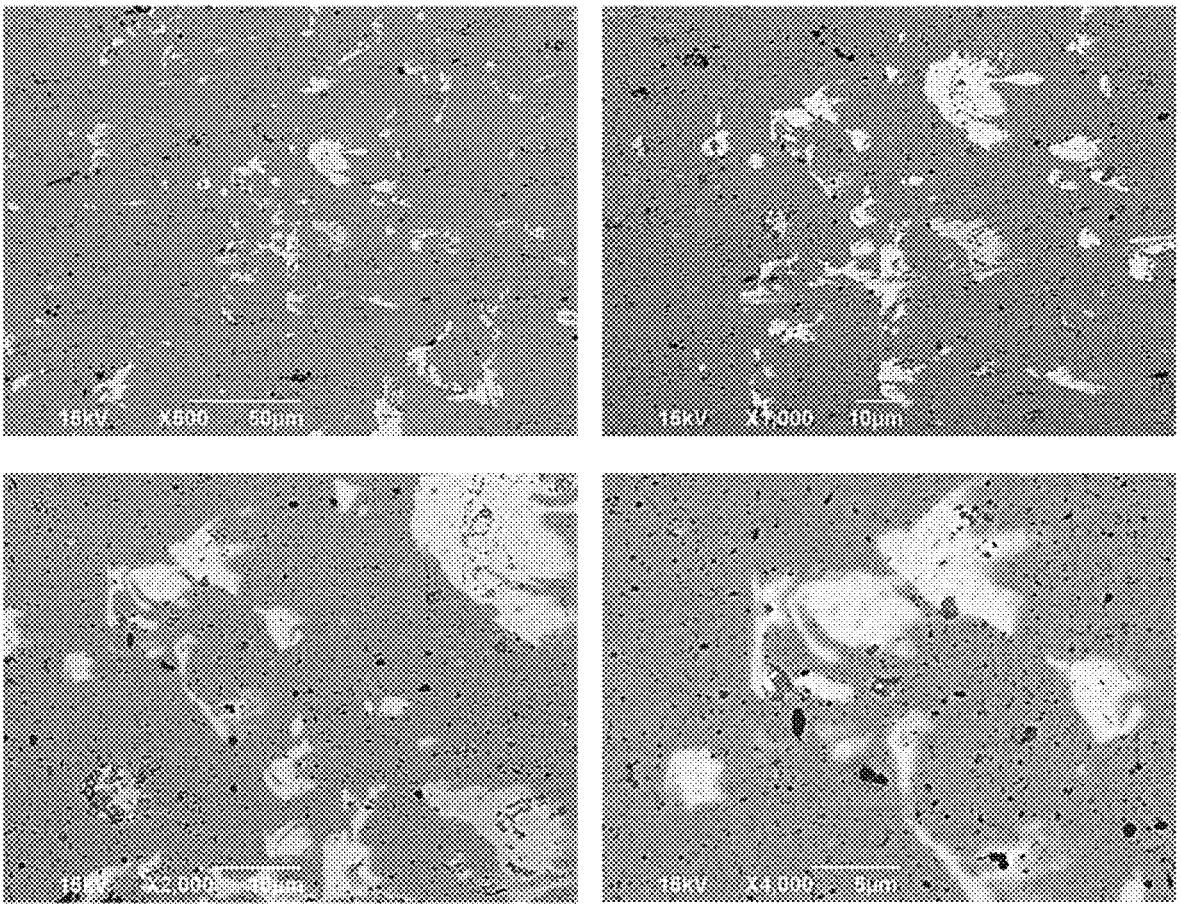
FIG. 19 shows cross-sectional SEM-BEI images in Experimental Example 4-1.
Figure 20:
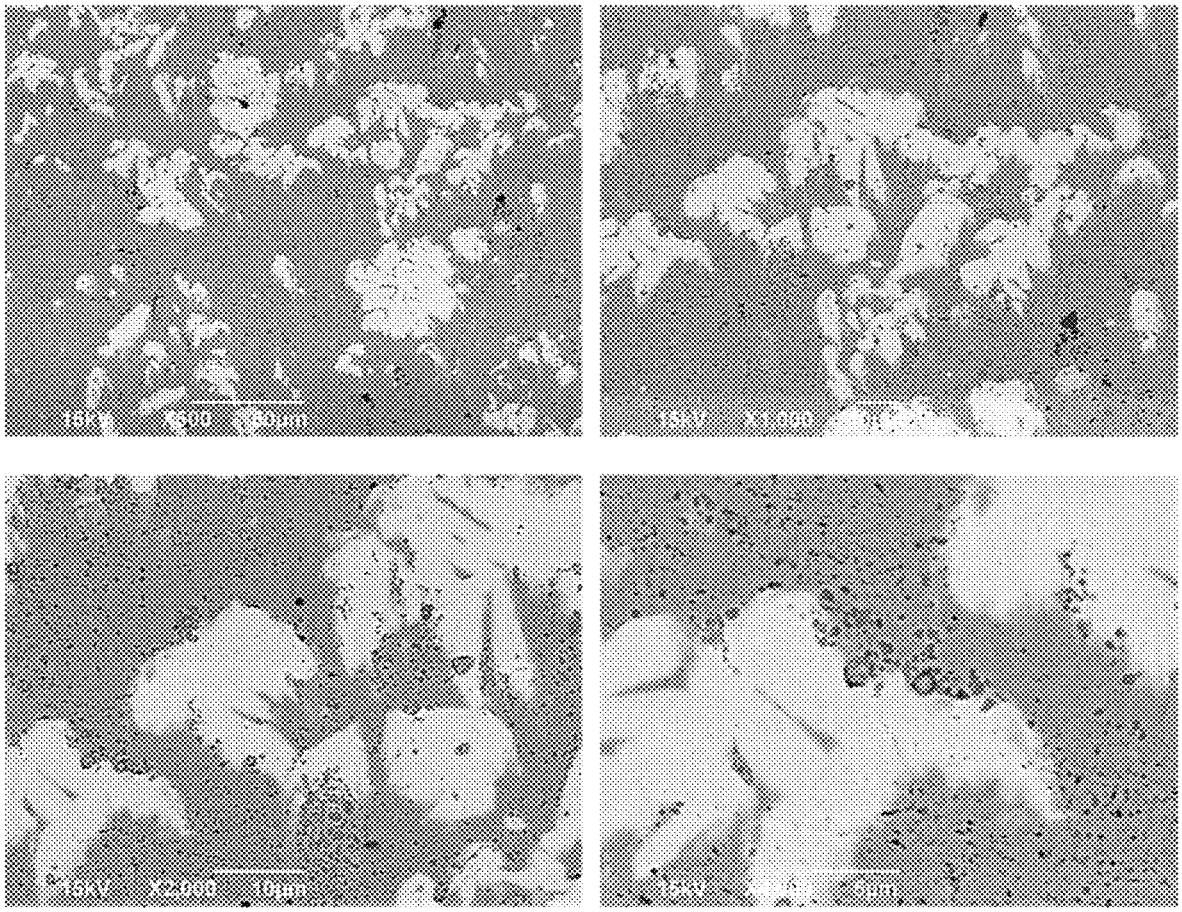
FIG. 20 shows cross-sectional SEM-BEI images in Experimental Example 4-2.
Figure 21:
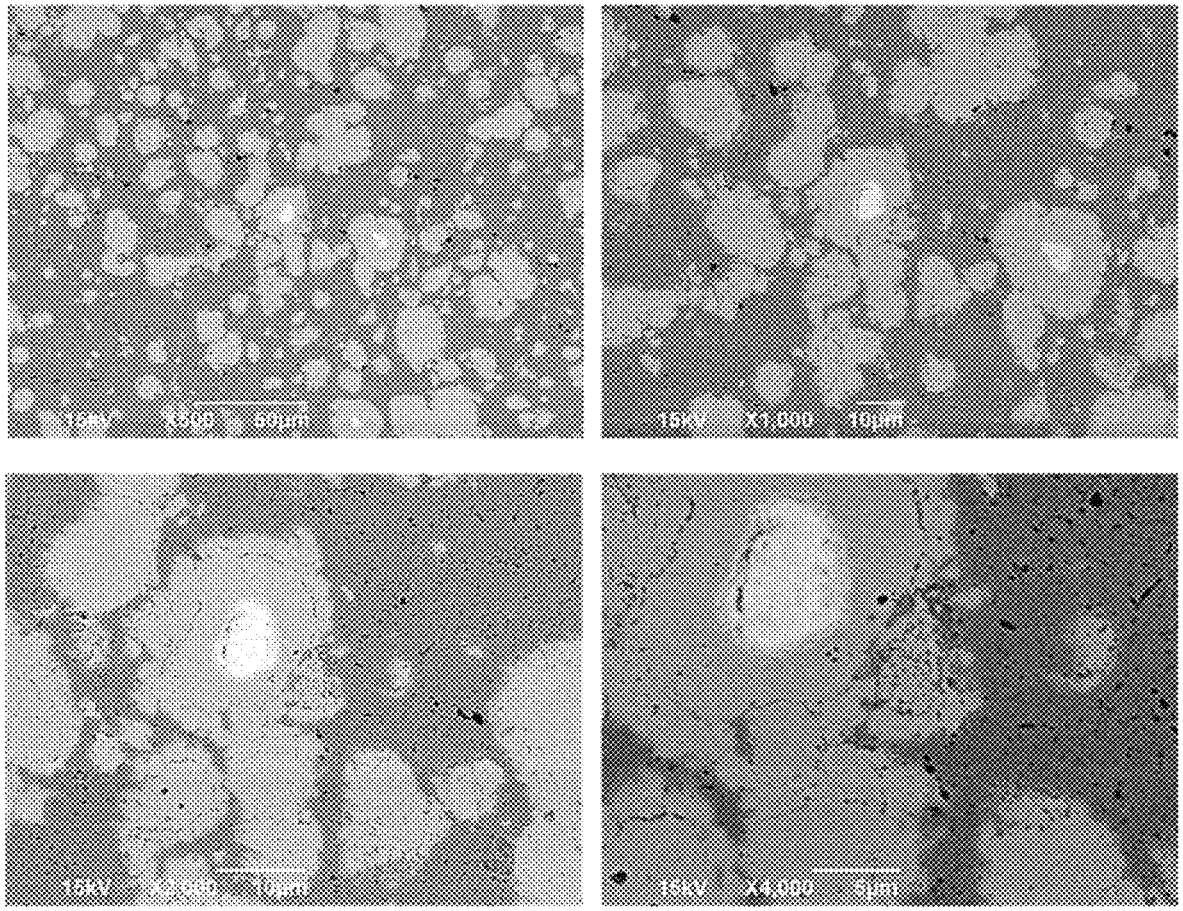
FIG. 21 shows cross-sectional SEM-BEI images in Experimental Example 4-3.
Figure 22:
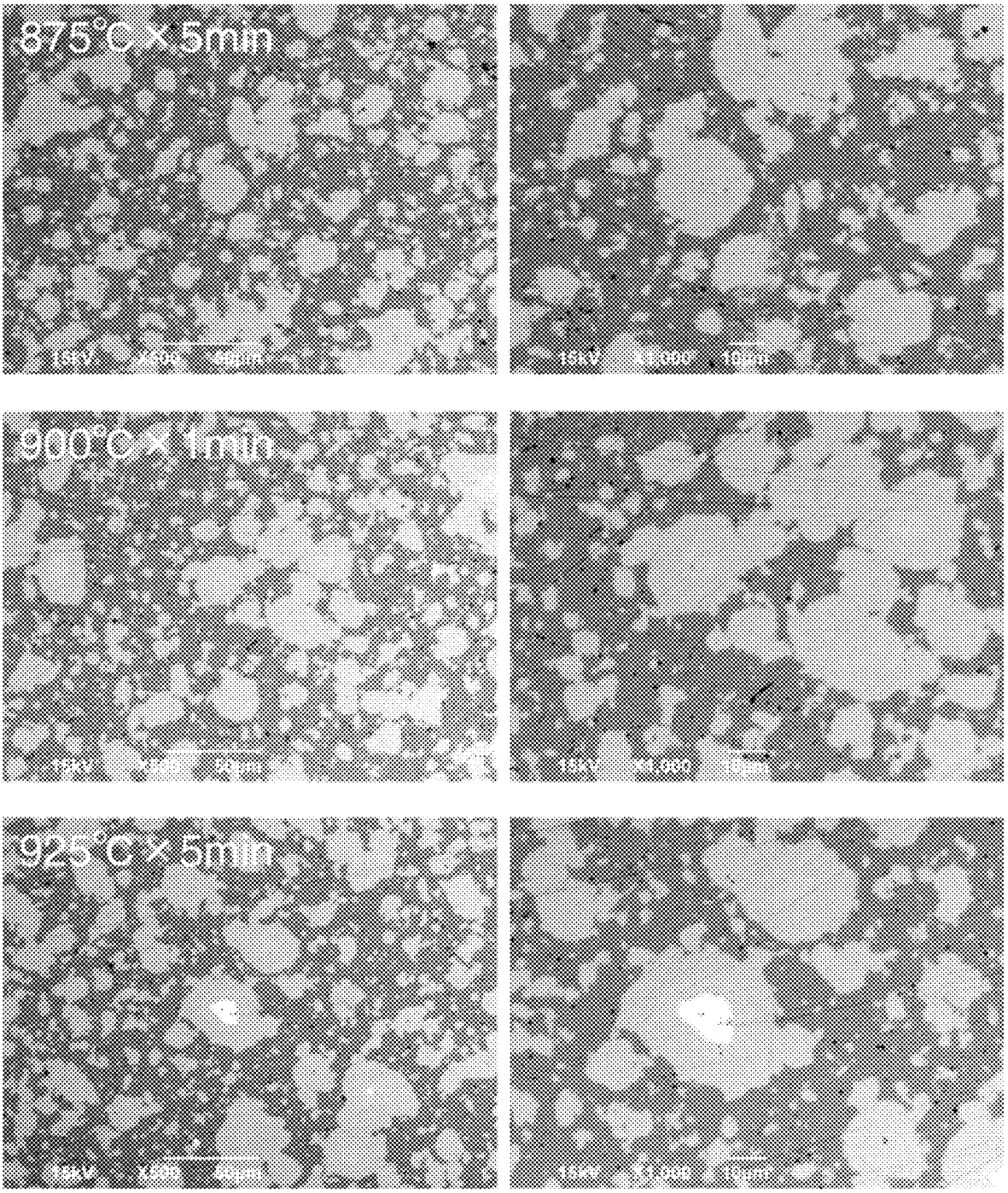
FIG. 22 shows cross-sectional SEM-BEI images of copper alloys prepared using different SPS temperatures and times.
Figure 23:
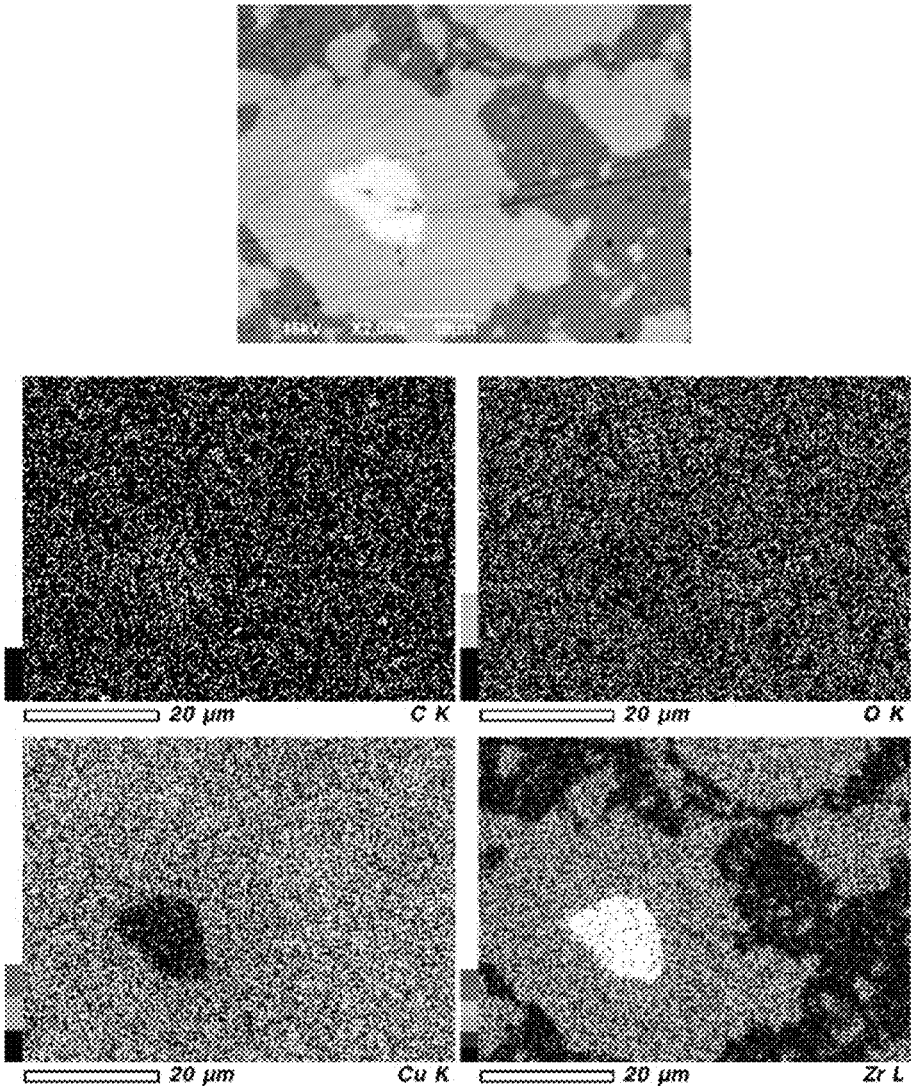
FIG. 23 shows a cross-sectional SEM-BEI image and elemental maps by the EDX method in Experimental Example 4.
Figure 24A:
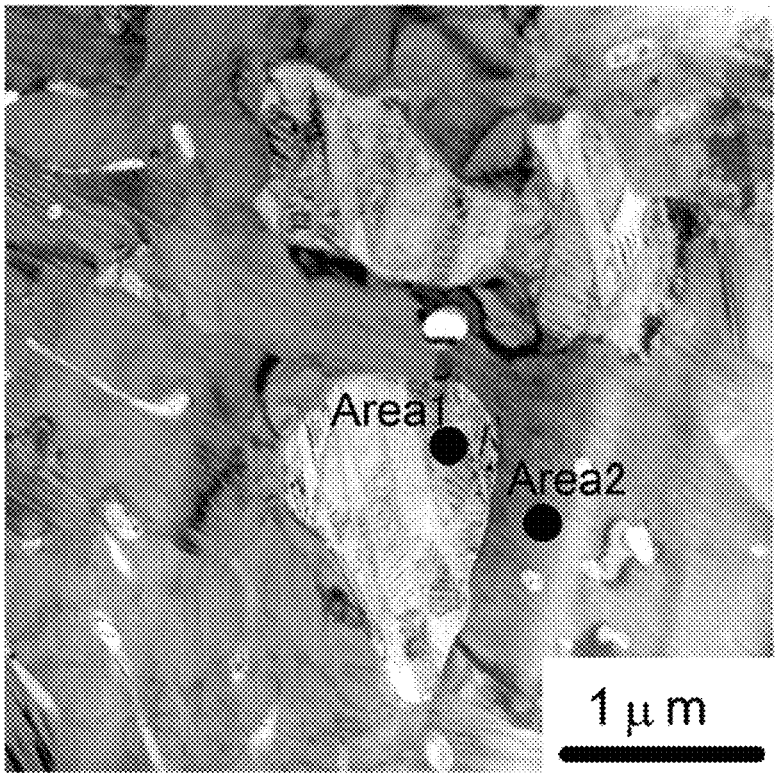
FIGS. 24A-24C show a cross-sectional TEM-BF image and SAD patterns in Experimental Example 4-3.
Figure 24B:
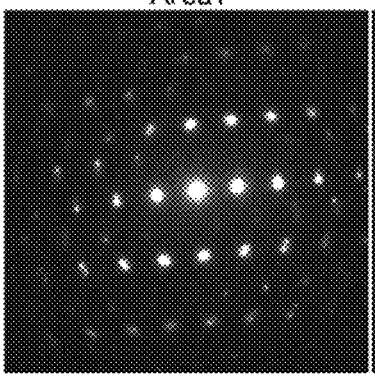
Figure 24C:
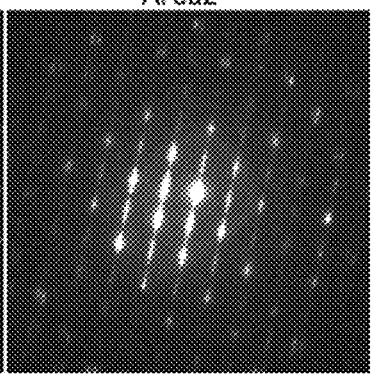

Next, Experimental Example 4 was examined in detail. FIG. 19 shows cross-sectional SEM-BEI images in Experimental Example 4-1. FIG. 20 shows cross-sectional SEM-BEI images in Experimental Example 4-2. FIG. 21 shows cross-sectional SEM-BEI images in Experimental Example 4-3. The average particle diameters D50 of the second phase in the SEM photographs taken were determined in the same manner as described above. As shown in the SEM photographs in FIGS. 19 and 20, in each of the copper alloys in Experimental Example 4, the average particle diameter D50 of the second phase in cross section was within the range of 1 μm to 100 μm. It was found that the second phase was in the form of coarse particle having an outer shell composed of the Cu—Zr-based compound phase containing $Cu_5Zr$ and a core including the Zr-rich Zr phase (FIG. 21). FIG. 22 shows cross-sectional SEM-BEI images of copper alloys having the same composition as in Experimental Example 4-3 and prepared using different SPS temperatures and times. It was found that, when the SPS process was performed at 925° C. for 5 minutes, a Zr phase was generated. FIG. 23 shows a cross-sectional SEM-BEI image and elemental maps by the EDX method in Experimental Example 4. As shown in FIG. 23, it was inferred that the core of the second phase was the Zr-rich Zr phase in which the amount of Cu was small and the amount of Zr was extremely large. FIG. 24A shows a cross-sectional TEM-BF image in Experimental Example 4-3. FIG. 24B shows an SAD pattern of Area 1, and FIG. 24C shows an SAD pattern of Area 2. A microstructure including twin crystals was also observed in the $Cu_5Zr$ compound phase in the SPS materiel shown in FIGS. 24A-24C. FIG. 24B shows an SAD (Selected Area Diffraction) pattern of Area 1 in the microstructure shown in FIG. 24A, and FIG. 24C shows an SAD pattern of Area 2 in the microstructure shown in FIG. 24A. The selected-area aperture was 200 nm. EDX analysis was also performed at the central portions of these Areas. The results showed that the microstructure observed in Area 1 was a Zr-rich phase containing κ at % of Cu similar to that in the SPS materials in Experimental Example 3 and three lattice spacings measured agreed with those of the α-Zr phase within 1.2%. The compound phase in Area 2 was the same $Cu_5Zr$ compound phase as that in the SPS materials in Experimental Examples 1 and 3.

Figure 25:
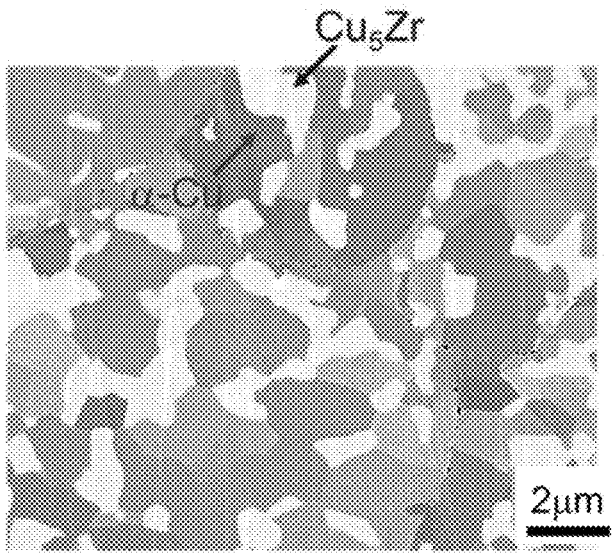
FIG. 25 shows an SEM-BEI image of a copper alloy in Experimental Example 1-3 and the results of measurements of hardness by the nano-indentation method and Young's modulus.
Figure 26A:
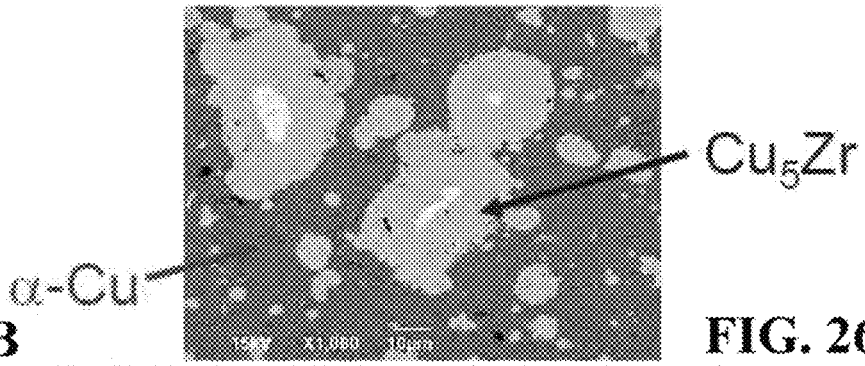
FIGS. 26A-26C show a cross-sectional SEM-BEI image and elemental maps by the EDX method in Experimental Example 2-3.
Figure 26B:
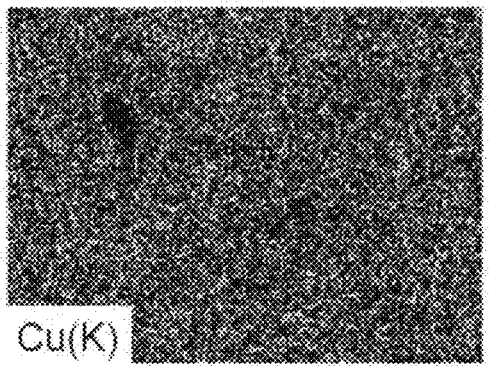
Figure 26C:
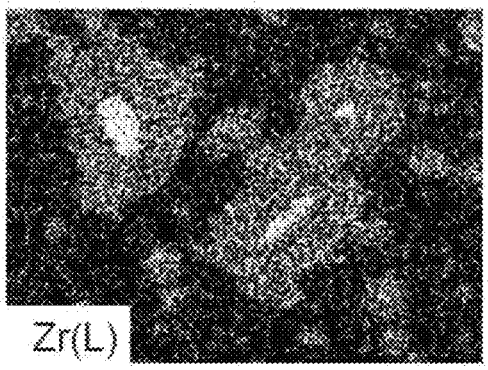

Experimental Examples 1 and 2 were examined. FIG. 25 shows an SEM-BEI image of the copper alloy in Experimental Example 1-3 that was obtained by subjecting a Cu—Zr-based alloy powder to SPS. As shown in FIG. 25, the Young's modulus E of the Cu—Zr-based compound phase was 159.5 GPa, and its hardness H was 6.3 GPa (=585 MHv in terms of Vickers hardness). FIGS. 26A-26C show a cross-sectional SEM-BEI image and elemental maps by the EDX method in Experimental Example 2-3. As shown in FIGS. 26A-26C, this copper alloy produced using Cu powder and Zr powder had a structure in which relatively large domains of the second phase were dispersed in the α-Cu matrix phase. It was found that the second phase had an outer shell composed of a Cu—Zr-based compound phase containing $Cu_5Zr$ and a core including a Zr-rich Zr phase. In Experimental Example 2, it was inferred that the Zr powder remained present even after the sintering step.

Figure 29:
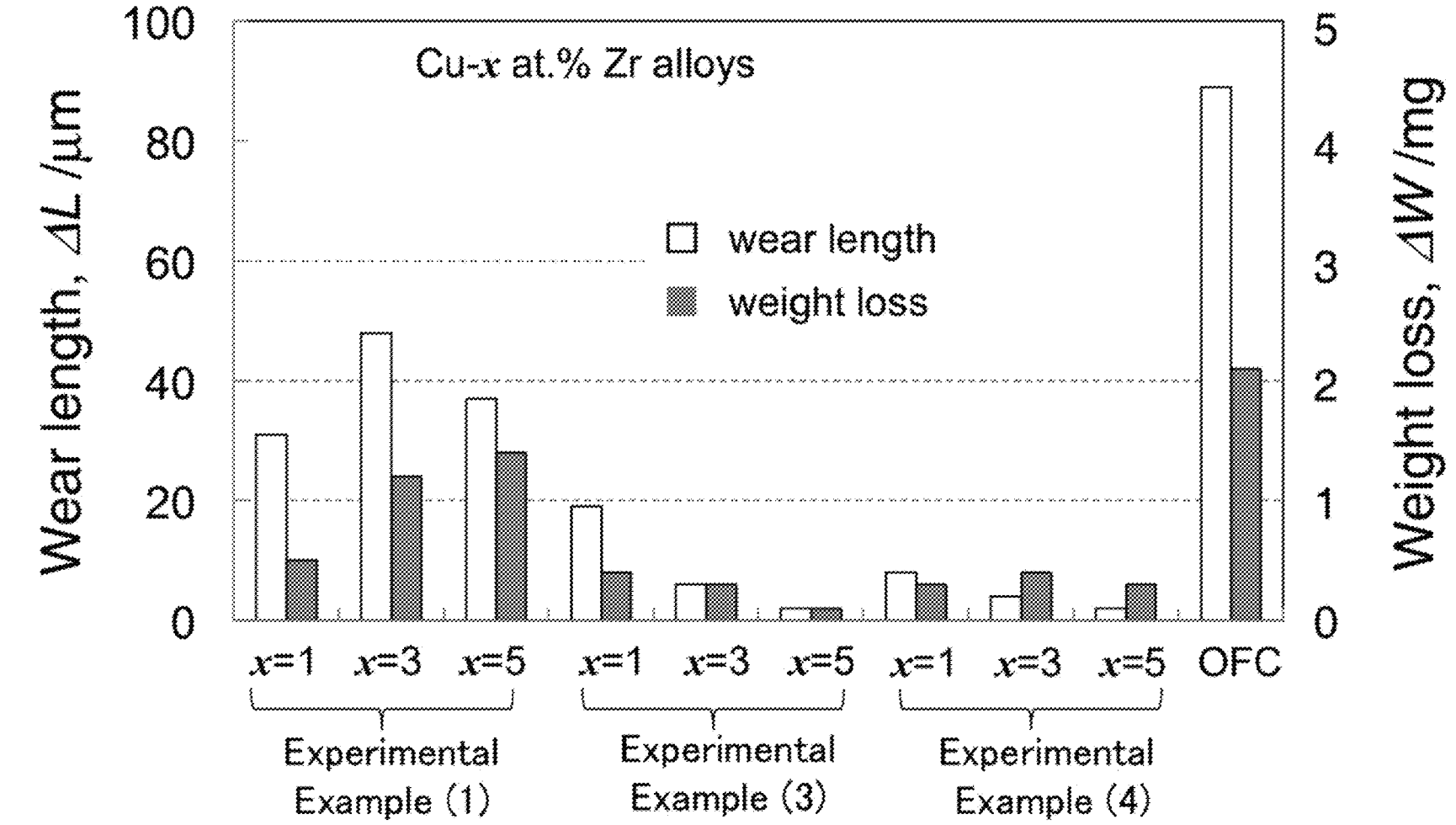
FIG. 29 shows the results of the pin-on-disk sliding wear test in Experimental Examples 1, 3, and 4.

A pin-on-disk sliding wear test (according to JIS K7218) was performed using Experimental Examples 1, 3, and 4. FIGS. 27A and 27B show the results of the pin-on-disk sliding wear test (according to JIS K7218) in Experimental Example 1. FIGS. 28A-28C show the results of the pin-on-disk sliding wear test in Experimental Examples 3 and 4. FIG. 29 summarizes the results of the pin-on-disk sliding wear test in Experimental Examples 1, 3, and 4. The pin-on-disk sliding wear test was performed as follows. A test pin having a diameter of 2 mm and a height of 8 mm was cut from one of the SPS materials in the Experimental Examples, and the cut test pin was brought into contact with a S45-made disk rotated at 200 rpm. In this case, Daphne Super Hydro 46A mineral oil manufactured by Idemitsu Kosan Co., Ltd. was dropped onto the rotating disk. The test was performed as follows. A contact pressure of 2 MPa was applied, and this state was maintained for 1 minute. Then the contact pressure was increased to 20 MPa in steps of 1 MPa. Each time after the contact pressure was increased, the resulting state was maintained for 1 minute. Then (a) a change in friction coefficient, (b) the wear length of the pin after the test, and (c) the weight loss by wear were measured three times, and the averages were determined. The pin-on-disk sliding wear test was also performed on OFC (oxygen-free copper: JIS C1020) as a Comparative Example. As shown in FIGS. 27A and 27B, in Experimental Example 1, the particle diameters of the Cu—Zr-based compound were small, and the structures were relatively uniform. Therefore, the friction coefficient in Experimental Example 1 was smaller and more stable than that of OFC even when the contact pressure was high, so that the wear length of each pin and its weight loss were small. As shown in FIGS. 27 to 29, in Experimental Examples 3 and 4, as in Experimental Example 1, the stability of the friction coefficient and the wear resistance were better than those of OFC.

As described above, in Experimental Examples 3 and 4 in the Examples, one of the Cu—Zr master alloy and $ZrH_2$ that are relatively chemically stable is used as a raw material. This allows a copper alloy comparable to those in Experimental Example 1 that have improved electrical conductivity and improved mechanical strength and are excellent in wear resistance to be produced by a simpler process.

The present invention is not limited to the Examples described above. It will be appreciated that the present invention can be embodied in various forms so long as they fall within the technical scope of the invention.

The present application claims priority from U.S. Provisional Application No. 62/165,366 filed on May 22, 2015 and Japanese Patent Application No. 2015-204590 filed on Oct. 16, 2015, each of which is incorporated herein by reference in its entirety.

What is claimed is:

1. A method for manufacturing a copper alloy, the method comprising the steps of:

(a) weighing a copper powder and one of a Cu—Zr master alloy and a $ZrH_2$ powder such that an alloy composition of Cu-xZr (x is the atomic % of Zr, and $0.5 \leq x \leq 8.6$ is satisfied) is obtained and pulverizing and mixing the copper powder and the one of the Cu—Zr master alloy and the $ZrH_2$ powder in an inert atmosphere until an average particle diameter D50 falls within the range of from 1 μm to 500 μm to thereby obtain a powder mixture; and (b) subjecting the powder mixture to spark plasma sintering by holding the powder mixture at a prescribed temperature lower than eutectic temperature while the powder mixture is pressurized at a pressure within a prescribed range, wherein the copper alloy has a structure in which a second phase is dispersed in a Cu matrix phase, the copper alloy having the following features (1) to (3):

(1) the average particle diameter D50 of the second phase in cross section is within the range of 1 μm to 100 μm;

(2) the Cu matrix phase and the second phase are present as two separate phases, and the second phase contains a Cu—Zr-based compound; and (3) the second phase has an outer shell composed of a Cu—Zr-based compound phase and a core portion including a Zr-rich Zr phase.

2. The method for manufacturing a copper alloy according to claim 1, wherein, in the step (a), the Cu—Zr master alloy used contains 50% by mass of Cu.

3. The method for manufacturing a copper alloy according to claim 1, wherein, in step (a), the copper powder, the Cu—Zr master alloy, and a grinding medium are mixed and pulverized while sealed in a closed container.

4. The method for manufacturing a copper alloy according to claim 1, wherein, in step (a), a $ZrH_2$ powder is used.

5. The method for manufacturing a copper alloy according to claim 1, wherein, in step (a), the copper powder, the $ZrH_2$ powder, and a grinding medium are mixed and pulverized while sealed in a closed container.

6. The method for manufacturing a copper alloy according to claim 1, wherein, in step (b), the powder mixture is inserted into a graphite-made die and then subjected to the spark plasma sintering in a vacuum.

7. The method for manufacturing a copper alloy according to claim 1, wherein, in step (b), the spark plasma sintering is performed at the prescribed temperature that is lower by 400° C. to 5° C. than the eutectic temperature.

8. The method for manufacturing a copper alloy according to claim 1, wherein, in step (b), the spark plasma sintering is performed at a pressure within the prescribed range, the prescribed range being from 10 MPa to 60 MPa inclusive.

9. The method for manufacturing a copper alloy according to claim 1, wherein, in step (b), the spark plasma sintering is performed for a holding time within the range of from 10 minutes to 100 minutes.

10. A copper alloy having a structure in which a second phase is dispersed in a Cu matrix phase, the copper alloy having the following features (1) to (3):

(1) the average particle diameter D50 of the second phase in cross section is within the range of 1 μm to 100 μm;

(2) the Cu matrix phase and the second phase are present as two separate phases, and the second phase contains a Cu—Zr-based compound; and (3) the second phase has an outer shell composed of a Cu—Zr-based compound phase and a core portion including a Zr-rich Zr phase.

11. The copper alloy according to claim 10, further having at least one of features (4) and (5):

(4) the Cu—Zr-based compound phase serving as the outer shell has a thickness of 40% to 60% of a particle radius which is the distance between a particle outermost circumference and a particle center; and (5) the Cu—Zr-based compound phase serving as the outer shell has a hardness of 585±100 MHv in terms of Vickers hardness, and the Zr phase serving as the core has a hardness of 310±100 MHv in terms of Vickers hardness.

12. The copper alloy according to claim 10, wherein the Cu—Zr-based compound phase contains $Cu_5Zr$.

13. The copper alloy according to claim 10, wherein the copper alloy is formed by subjecting a powder mixture of a copper powder and a Cu—Zr master alloy or a powder mixture of the copper powder and a $ZrH_2$ powder to spark plasma sintering.

* * * * *